US007281422B2

(12) United States Patent
Keller

(10) Patent No.: US 7,281,422 B2
(45) Date of Patent: Oct. 16, 2007

(54) METHOD FOR BOREHOLE CONDUCTIVITY PROFILING

(76) Inventor: Carl E. Keller, 6 Easy St., Santa Fe, NM (US) 87504

( * ) Notice: Subject to any disclaimer, the term of this patent is extended or adjusted under 35 U.S.C. 154(b) by 217 days.

(21) Appl. No.: 11/095,081

(22) Filed: Mar. 30, 2005

(65) Prior Publication Data

US 2005/0172710 A1 Aug. 11, 2005

Related U.S. Application Data

(63) Continuation-in-part of application No. 10/657,026, filed on Sep. 4, 2003, now Pat. No. 6,910,374.

(60) Provisional application No. 60/558,536, filed on Mar. 31, 2004.

(51) Int. Cl.
*E21B 49/00* (2006.01)
*G01N 15/08* (2006.01)

(52) U.S. Cl. ..... 73/152.41; 73/38; 166/250.02; 166/250.03

(58) Field of Classification Search ..... 73/38, 73/152.01, 152.41; 166/250.02, 250.03
See application file for complete search history.

(56) References Cited

U.S. PATENT DOCUMENTS 4,064,211 A * 12/1977 Wood ..... 264/516
4,385,885 A * 5/1983 Wood ..... 425/387.1
5,520,248 A * 5/1996 Sisson et al. ..... 166/250.02

* cited by examiner

*Primary Examiner*—Daniel S. Larkin
(74) *Attorney, Agent, or Firm*—Rod D. Baker

(57) ABSTRACT

A method of using an everting borehole liner to perform fluid conductivity measurements in materials surrounding a pipe, tube, or conduit, such as a borehole below the surface of the Earth. A flexible liner is everted (turned inside out) into the borehole by introducing into the liner a pressurized driving fluid. As the liner displaces the ambient fluid in the borehole into the surrounding formation, the varying rate at which driving fluid is introduced into the liner is monitored and recorded. As the impermeable liner covers the flow paths in the wall of the hole, the rate at which driving fluid must be introduced slows. From the measured driving fluid introduction rate, the flow rates out discrete sections of the borehole are determined.

22 Claims, 21 Drawing Sheets

METHOD FOR BOREHOLE CONDUCTIVITY PROFILING

CROSS-REFERENCE TO RELATED APPLICATIONS

This application is a continuation-in-part application of U.S. patent application Ser. No. 10/657,026 entitled "Borehole Conductivity Profiler," filed on Sep. 4, 2003, now U.S. Pat. No. 6,910,374, and the specification thereof is incorporated herein by reference.

This application also claims the benefit of the filing of U.S. Provisional Patent Application Ser. No. 60/558,536, entitled "Borehole Conductivity Profiler", filed on Mar. 31, 2004, and the specification thereof is incorporated herein by reference.

BACKGROUND OF THE INVENTION

1. Field of the Invention (Technical Field)

The present invention relates to measuring the hydraulic conductivity of layers of the Earth's subsurface, and particularly to a method including deploying a flexible everting liner, for providing a continuous direct measurement of the location and flow rate of geological fractures and permeable beds intersecting a borehole.

2. Background Art

Many kinds of measurements may be made to assess the characteristics of fluid flow paths in the Earth's subsurface. Most measurements are made in a borehole drilled into the geologic formations of interest. The common borehole is measured with a variety of "logging" techniques to locate fractures, to measure flow velocities in the hole, to measure the temperature effects of flowing water, and to identify potential flow paths such as permeable beds with unique measurable properties. Known measurement techniques typically involve acoustics, electrical resistivity, video scans, natural radiation detection, and induced radiation. Many of these measurements using current techniques are only indirectly related to the specific flow characteristics desired. Other measurement approaches for flow path assessments involve the use of "packers": single, double, or more, inflatable bladders which are used to isolate a portion of the hole. The isolated portion, comprising only a section of the vertical extent of the borehole, is then pumped to assess the flow from, or into, the hole wall under specific driving conditions.

It is desirable to have an improved mode for measuring hydraulic conductivity and related characteristics more directly. The present invention does so by deploying a special liner apparatus down the borehole. Everting liner technology is best described in patents previously issued to the inventor of the present application. These patents are U.S. Pat. No. 6,298,920 issued Oct. 9, 2001; U.S. Pat. No. 6,283,209 issued Sep. 4, 2001; U.S. Pat. No. 6,244,846 issued Jun. 12, 2001; and U.S. Pat. No. 6,026,900 issued Feb. 22, 2000. Beneficial reference may be made to these patents, and their teachings are hereby incorporated by reference.

SUMMARY OF THE INVENTION (DISCLOSURE OF THE INVENTION)

A method is described of using an everting borehole liner to perform fluid conductivity measurements in materials surrounding a pipe, tube, or conduit, such as a borehole below the surface of the Earth. A flexible liner is everted (turned inside out) into the borehole by introducing an internal pressurized fluid, called the driving fluid, into the liner. The driving fluid causes the liner to evert, with a point of eversion moving along the bore hole. The surface of the driving fluid stands in the liner at an elevation which may vary somewhat during liner eversion. The rate at which driving fluid is introduced into the liner is monitored and measured over time. As the liner displaces the ambient fluid in the borehole into the surrounding formation, changes in the rate of driving fluid introduction is recorded. As the impermeable liner covers flow paths in the wall of the hole, the rate of fluid introduction needed to maintain the driving fluid level slows. From the measured changes in driving fluid introduction, the flow rates out of discrete sections of the borehole can be determined.

There is provided according to the invention a method for determining hydraulic conductivity of material surrounding a conduit or borehole, comprising the steps of: sealably fastening a first end of a flexible liner to a proximate end of the borehole; introducing a driving fluid into the liner to a driving fluid level, thereby everting the liner down the borehole; measuring the rate of driving fluid introduction; monitoring changes in the driving fluid level; and calculating the conductivity of the surrounding material from the rate of driving fluid introduction and from any changes in the driving fluid level. "Introducing driving fluid into the liner" may comprise pressurizing the liner with a fluid, such as water. The step of measuring the rate of driving fluid introduction preferably comprises discharging driving fluid through a flow meter adjacent to the proximate end of the borehole, while monitoring changes in the driving fluid level preferably comprises monitoring a pressure meter within in the fluid within the liner.

The method may include the further steps of monitoring the pressure within the liner and monitoring liner tension to determine a driving pressure. Also, the further step may be taken of measuring fluid pressure in the borehole below an everting end of the liner. Practice of the method optionally may include withdrawing the liner upward in the borehole so that the liner ascends the borehole while monitoring a tension due to the resistance, to ascension, of the ascending liner. Such optional procedure still may include the step of measuring fluid pressure in the borehole below an everting end of the liner, as well as measuring the rate of driving fluid produced at the first end of the liner.

"Calculating conductivity" preferably comprises determining a gross fluid flow rate outward into the surrounding material from a segment of the borehole at the everting end of the liner. In the method of the invention, "measuring the rate of driving fluid introduction" preferably comprises monitoring for changes in the rate of fluid introduction, wherein when the liner covers a flow path in the surrounding material, the gross fluid flow rate is reduced by the amount of flow in the flow path, concurrently affecting the rate of driving fluid introduction. The object of the invention is best realized by plotting the rate of driving fluid introduction versus borehole depth to locate changes in conductivity associated with changes in fluid introduction.

Thus, there is disclosed a method of determining physical characteristics of materials surrounding a subsurface borehole, the borehole having at least some ambient water standing therein, comprising the steps of: sealing an upper end of a flexible liner to a proximate end of the borehole; driving the liner down the borehole, while allowing the liner to evert at an eversion point descending the borehole, by introducing a driving fluid into the liner; continuously measuring the rate at which driving fluid is introduced into the liner; determining, from the rate at which the driving fluid is introduced, a gross flow rate of the ambient water outward into the surrounding material from a segment of the borehole adjacent the eversion point of the liner; and calculating from the gross flow rate a characteristic of the surrounding material.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
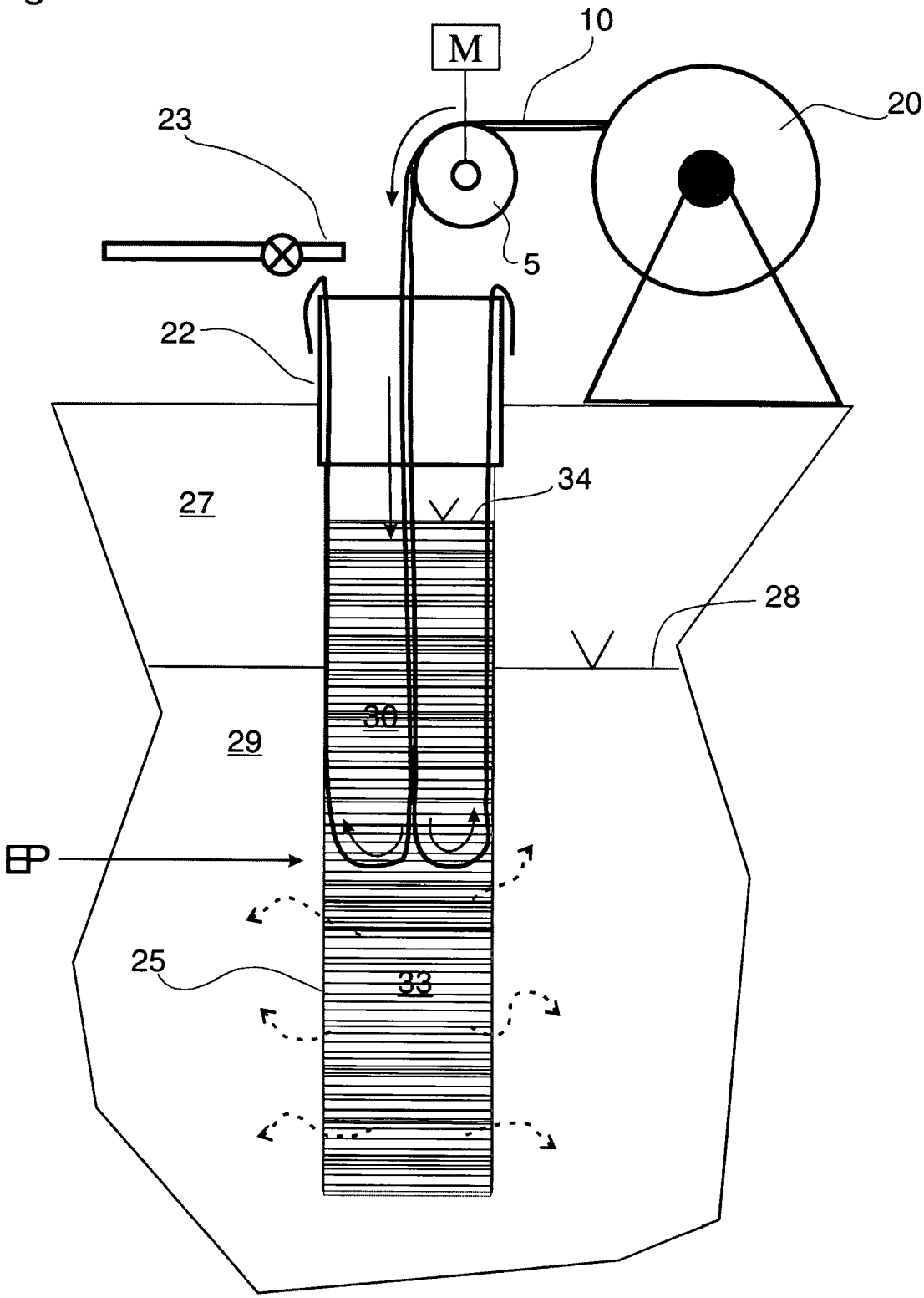
FIG. 1 is a side sectional view (of varying scale) of an embodiment of the present invention being practiced below the surface of the ground.

DESCRIPTION OF THE PREFERRED EMBODIMENTS (BEST MODES FOR CARRYING OUT THE INVENTION)

Evaluating major flow paths from a hole is the main purpose of many geophysical measurements in boreholes. One method of assessing flow paths from boreholes is the use of straddle packers to isolate sections of the hole for measurement. Another method is the use of video cameras to examine fractures, if the water in the hole is sufficiently clear. Yet other techniques are used to assess the conductivity of the entire hole such as falling head slug tests or pumping tests.

The primary use contemplated for the invention is in subsurface boreholes drilled into the earth. However, the invention finds utility in pipes and conduits, as well. Throughout this disclosure and in the claims, "borehole" shall have a meaning including man-made conduits such as pipes and tubes, as well as subsurface boreholes.

The present invention uses an everting borehole liner to perform subsurface fluid conductivity measurements. The liner apparatus is similar in some respects to the device described in U.S. Pat. No. 5,803,666, the disclosure of which is incorporated herein by reference. The present invention uses the everting liner in an innovative method for measuring certain subsurface characteristics. To "evert" means to "turn inside out," i.e., as a flexible, collapsible, tubular liner is unrolled from a spool, it simultaneously is topologically reversed so the outside surface of the tube becomes the inside surface.

In the present invention, the liner is everted into the hole, such as a vertical borehole for example, with pressurized fluid in the liner. The driving fluid is introduced into the liner, as by pumping or pouring, to provide fluid pressure within the liner, causing it to evert into the borehole. As the liner displaces the ambient fluid in the borehole, forcing it into the surrounding formation, the rate at which driving fluid must be introduced into the liner is monitored and recorded over time (while maintaining a level of driving fluid standing in the liner while the liner's point of eversion descends). As the liner covers the flow paths in the wall of the hole, the rate of driving fluid introduction can be slowed. From the measured rate of driving fluid introduction, the flow rates out discrete sections of the borehole are determined. This direct measurement of the characteristics of flow paths radially out from the borehole, by monitoring the rate of fluid introduction into the everting liner, is a central facet of the present invention. Both the hardware design and the method of analysis are described hereafter, and constitute aspects of the invention.

A leading advantage of the technique is that it requires less than 10% of the time for the typical logging or packer testing. Another advantage is that an impermeable liner often is installed in any event, for the purpose of simply sealing the borehole against flow. By the invention, data is collected at very little extra cost during the normal liner installation.

Generally characterized, the apparatus according to the present invention includes an encoder on a wellhead roller to measure the depth (versus time) of an everting liner. From the depth vs. time data the velocity of the liner's eversion point may be calculated. The apparatus also includes a means for continuously monitoring the driving pressure of the everting liner. The monitoring means may be a "bubbler" device of known configuration for monitoring the water level in the liner. Alternatively, pressure may be monitored by a simple pressure gauge for directly measuring the driving fluid pressure. In one embodiment, an additional component measures the tension exerted by the descending liner on a roller or spool at the surface. This tension measurement is a first-order correction to the conductivity inferred from the pressure and descent rate alone. In circumstances of a relatively deep water table, the tension measurement is essential to control any resistance to the liner's descent that is attributable to excessive liner tension. The tension measurement is very important if the conductivity measurement is performed during the extraction, rather than during the installation, of the liner in the hole.

In another embodiment, a means is provided for measuring and monitoring the rate at which driving fluid (typically water) is introduced, as by pouring or pumping, into the liner to cause the eversion. Driving fluid "stands" at a level in the everting liner, but as the eversion point moves away from the driving fluid inlet, additional driving fluid is introduced to maintain as best as possible a stable driving fluid level. Thus, as the point of eversion moves along the borehole, driving fluid must constantly be introduced into the liner, and the rate of introduction measured.

The invention includes a method for performing measurements of subsurface characteristics. The use of the everting liner requires an analysis of the measured parameters to determine the transmissivity of discrete portions of the borehole. The process at the borehole may be succinctly described. The liner is inserted down the hole by driving it with a fluid pressure; it descends like a nearly perfectly fitting piston in the borehole. Above the everting end of the liner, the wall of the hole is effectively sealed by the liner. The liner's rate of descent, and/or the rate at which driving fluid is introduced, is used to calculate the gross fluid flow rate radially outward (into the surrounding subsurface regime) from the segment of the hole below the everting end of the liner. When the liner covers a comparatively significant flow path into the adjacent formation, the flow rate out of the open hole beneath the eversion point is reduced by the amount of flow in that path. The change in flow rate concurrently affects the rate at which driving fluid must be introduced to maintain a stable drive fluid level. Alternatively, the change in flow rate concurrently changes the liner descent rate (velocity). A plot of rate of driving fluid introduction versus depth (and/or descent rate versus depth) shows the location of major flow paths by an associated drop in the required rate of driving fluid introduction corresponding to the location of the flow path.

Because the driving pressure in the liner is not necessarily constant, the conductivity calculation must include the driving pressure as a variable as well as several other important parameters such as the local "head" in the formation, the effect of any tension applied to the liner deliberately or through friction in the system, and other influential factors. The result is the distribution and magnitude of fluid conductivity (and thus permeability) of the subsurface geologic formations. The plotted results can be printed at the completion of the liner installation, using a computer and printer of off-the-shelf availability.

The inventive technique was used to deduce conductivity variations, relative to depth, in a vertical hole. The results from the invention were compared to conventional "packer test" results with very similar conductivity values. Notably, the conductivity profiler installation according to the present invention required about thirty minutes for these people to install to 300 ft. In contrast, the packer test procedure required four days for two people.

An advantage of the present invention is that an everting liner provides a continuous direct measurement of the location and flow rate of fractures and permeable beds intersecting the borehole. Since this is a direct measurement, there is no requirement for elaborate expert interpretation of the data. The procedure is relatively quick (e.g., from thirty minutes to about 1.5 hours for a complete profile of a 330-ft (100 m) hole). (The foregoing may be compared to the four days that likely would be required for a complete suite of straddle packer tests of the same hole.) Further, unlike straddle packers, with the present invention there is little concern about leakage past the seal. The data set includes a continuous measurement of the transmissivity of the hole. Therefore, the integral of flow from the hole using the measured transmissivity values is internally consistent. Whereas, any leakage past packers (e.g., in a highly fractured or rough interval of the hole) leads to an upper limit rather than a real, or self-consistent, set of transmissivity values.

Reference is made to FIG. 1, illustrating the installation of a sealing liner according to one embodiment of the invention. Installation is easily performed by a field technician after very modest training. For the sake of clarity, in FIG. 1 the relative sizes of the sub-surface components of the invention are exaggerated relative to the sizes of components on the surface. FIG. 1 shows the initiation of the invention after the liner 10, which is inside-out while wound around the spool or reel 20, is clamped to the surface casing 22 at the upper or proximate end of the previously drilled borehole 25. The borehole 25 is drilled into the subsurface, normally through the vadose zone 27 and to below the water table 28. Consequently, the void of the borehole 25 below the water table 28 will tend to fill with ambient groundwater from the surrounding aquifer 29 or other, thinner, water-bearing strata. A short length of borehole 25, in the vicinity of the ground's surface, is provided at its top or proximate end with the well casing 22 according generally to convention.

The thin-walled liner 10 is manufactured from a suitably durable, but flexible, collapsible, and impermeable plastic or composite. For example, liner 10 may be composed of urethane bonded to nylon. The liner 10 deployed according to the invention is selected to have a diameter generally corresponding to, but never significantly less than, the diameter of the borehole 25.

The collapsed liner 10 is paid out from the rotating reel 20, and preferably is passed over a guide roller 15. The free end of the liner 10 is fastened and sealed to the proximate end of the casing 22. The liner 10 is then progressively filled with driving fluid 30, preferably water, introduced via above-ground fluid conduit 23. As indicated in FIG. 1, the fluid is poured into contact with the "outside" surface of the liner 10, but as a result of the pressure of fluid 30 pushing the liner 10 down the borehole 25, the collapsed tube of the liner is pressed against the walls of the borehole, resulting in the eversion of the liner. The eversion of the liner 10 occurs at a constantly moving eversion point EP as an ever greater length of the liner fills with driving fluid 30. The former "outside" surface of the liner 10 effectively becomes the inside surface, as the water or other fluid 30 introduced from the fluid conduit 23 inflates and fills the liner thereby to press the former "inside" surface of the liner securely against the wall of the borehole 25, as suggested by the darker directional arrows of FIG. 1. It is contemplated that the liner 10 is manufactured and disposed upon the reel 20 "inside out," so that the liner surface that eventually contacts the borehole wall initially defines the interior of the collapsed liner. As the borehole 25 fills with driving fluid 30, the driving fluid nevertheless is continually contained within the inflated liner 10, which impermeably lines the borehole above the downwardly moving eversion point EP. The liner 10 thus is passed along the borehole 25, with the eversion point EP moving at some velocity.

As a result of, among other things, the rapid introduction of driving fluid via the conduit 23, the driving fluid 30 fills the liner 10 to a driving fluid level 34 ordinarily somewhat above the vertical datum of the water table 28, as suggested by FIG. 1. At any given point along the borehole column, therefore, the hydraulic head within the liner 10 somewhat exceeds the head attributable to ambient subsurface water, such as the pressure from the saturated aquifer 29.

The pressure of the fluid 30 drives the liner 10 down the hole 25 somewhat like a piston. The flexible liner 10 under pressure, however, conforms to the irregular borehole wall, and does not slide on the borehole wall. With continuing forced introduction of driving fluid at the top of the borehole 25, the liner 10 distends, elongates, and inflates toward the borehole wall. Again, the expansion of the liner 10 occurs at the eversion point EP where the liner is turning inside out, which point is at the lower-most point or annulus of the liner.

As noted, the borehole 25 below the water table 28 tends to fill with ground water 33 to a level approximating the vertical level of the water table 28. As the liner 10 descends the borehole 25 under the pressure of the driving fluid 30, however, it forces the standing water 33 from within the bore, through the borehole wall, and back into the surrounding strata 29, as indicated by the lighter, convoluted directional arrows in FIG. 1. The displacement of the ambient water 33 by the driving fluid 30, thereby to force the ambient water back across the borehole wall and into the surrounding geologic regime, is a central aspect of the operation of the invention. This "backflow" out of the hole 25 into the subsurface strata 29 allows the measurement of the hydraulic conductivity of that strata.

As the liner 10 propagates down the borehole 25, it seals the hole borehole wall. The rate of descent of the liner (i.e., the downward velocity of the eversion point EP) is controlled by the flow paths (convoluted directional arrows in FIG. 1) from the borehole 25 into the surrounding strata 27, 29. As the liner 10 descends, it covers the flow paths into the surrounding strata, and thus hydraulically isolates the upper portion of the borehole above the eversion point EP. Consequently, the liner's rate of descent rate is dictated by the remaining fluid flow paths from the borehole below the liner's eversion point EP.

It is noted again that while this description of the invention refers to a "borehole" beneath the surface of the earth, the invention has practical utility in fluid transportation systems, such as above-ground or structural pipelines. It is or will be readily evident, for example, that the invention can be used to detect and locate leaks in pipes.

Figure 1A:
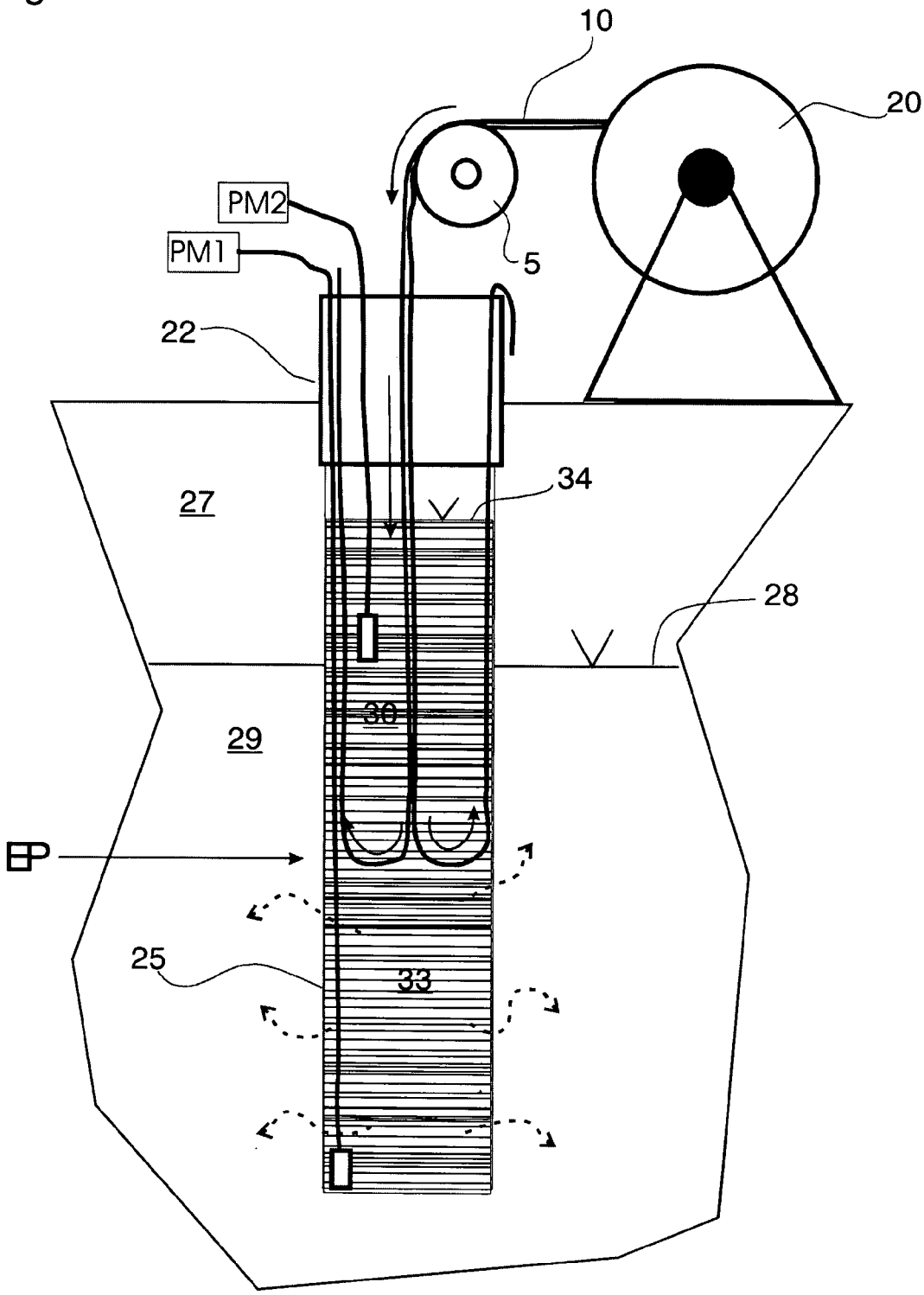
FIG. 1*a* is a sectional view (of varying scale) of an alternative embodiment of the apparatus shown in FIG. 1.

Further understanding of the invention is obtained by reference to FIG. 1*a*, depicting an alternative embodiment of the invention seen in FIG. 1. In this embodiment, there also is provided a pair of pressure meters, PM1 and PM2 for measuring the fluid pressure in the borehole at locations below and above the eversion point EP, respectively. Thus, by means of the first pressure meter PM1 and a second pressure meter PM2, the pressures below or above the point of liner eversion can be monitored. The pressure meters can be any suitable off-the-shelf transducer. If both meters PM1 and PM2 are deployed, the pressure differential can be monitored and tracked as well. As explained further herein, it is preferable to have a means for measuring at least the pressure above the eversion point EP, if not below the eversion point, for practicing the invention.

Reference is made to FIG. 1, showing a liner 10 that has progressed a significant distance down the borehole 25. The liner 10 preferably controllably unwound from a reel 20 and is passed over a roller 5. The roller assembly 15 is equipped with tension and position metering devices M, known in the art, for measuring the amount (length) of liner 10 that has been paid out, as well as for gauging the tension in the down-hole liner due to gravity. Thus, the meter M includes an encoder, in operative connection with the axle of the wellhead roller 15, to measure the depth of the everting liner in time. Additionally, by constantly monitoring the tension in the liner 10, the absolute driving pressure of the fluid within the liner can be ascertained, with the tension force providing a correction factor. The metering equipment collected in component M also includes a means for monitoring continuously the driving pressure of the everting liner. This driving pressure monitoring means may be a "bubbler" for monitoring the driving fluid level 34 within the liner 10, or a simple pressure gauge (such as pressure meter PM2 in FIG. 1*a*) for directly measuring the driving pressure. Further use of the metering devices M in an alternative manner of practicing the invention will be explained later herein.

When first inserted at the surface casing 22, the liner 10 starts with a maximum descent rate. The descent rate is dependent upon the rate at which the ground water 33 is forcibly displaced radially outwardly into adjacent subsurface formations by the descending liner 10. Each time the unwinding liner 10 covers a significant flow path into an adjacent stratum, for example the sand lens seen in FIG. 2, the liner's descent slows by an amount dependent upon the flow path thereby sealed. Stated differently, passing a large open fracture in a subsurface formation (e.g. within a layer of the saturated zone 29), or passing a stratum of high permeability, causes a large drop in the liner descent rate.

Figure 3A:
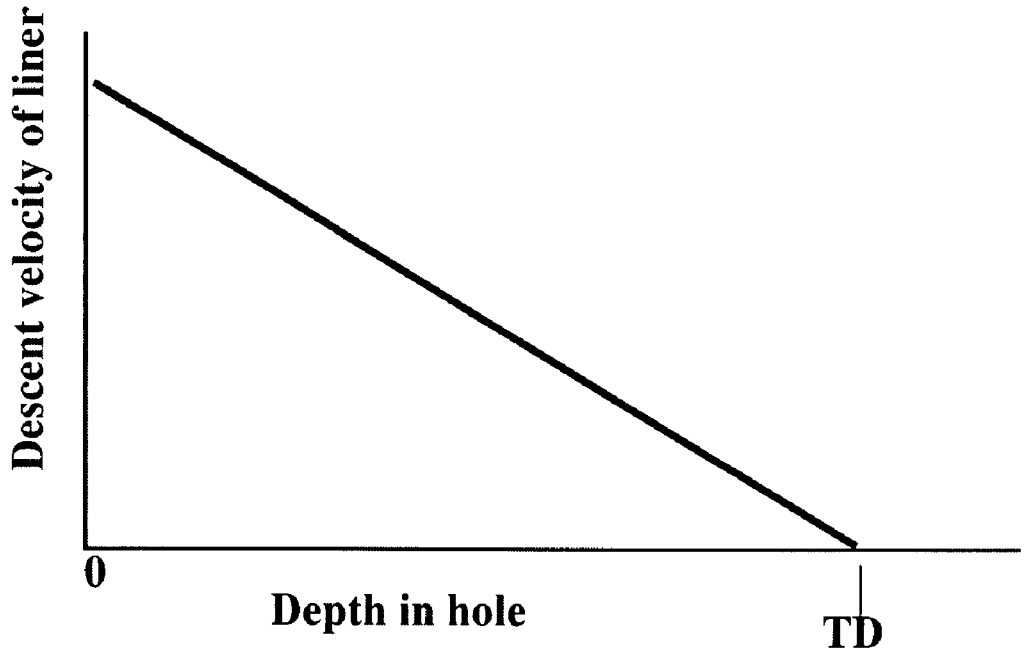
FIG. 3*a* is a graph showing qualitatively a hypothetical transmissivity profile that might be obtained by practicing the invention in a subsurface medium of uniform transmissivity.
Figure 3B:
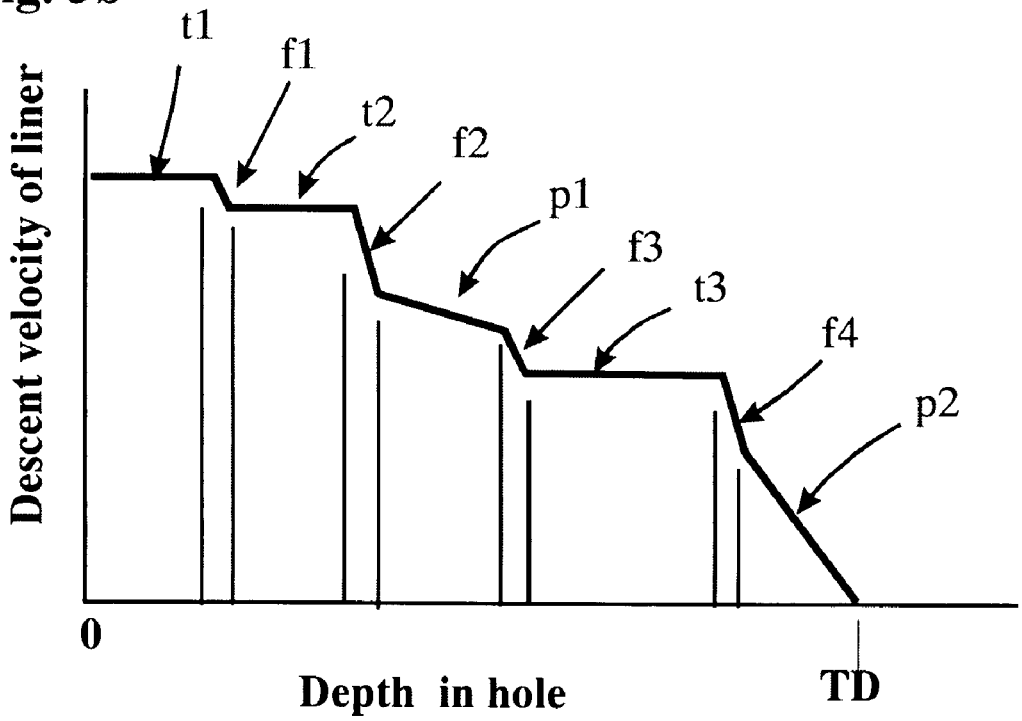
FIG. 3*b* is a graph showing qualitatively a hypothetical transmissivity profile that might be obtained by practicing the invention in subsurface media of non-uniform transmissivity.

A plot of the liner descent rate, in a hypothetical uniform conductivity medium (e.g., homogenous sand) is shown in FIG. 3*a*. It is a straight line, indicating that the rate of liner descent (the rate at which the point of eversion descends the borehole) is generally decreasing at a constant rate to the total depth (TD) of the borehole. The slope of the line suggests the conductivity of the medium, with steep slopes suggesting high conductivity. In contrast, in a fractured medium or layered media, the descent velocity versus depth is non-uniform, and the plot of descent rate versus depth may look, for example, like FIG. 3*b*. The velocity drops in abrupt steps (a large fracture) or a sloped step (a permeable zone). Constant velocity intervals are regions of little water loss from the borehole. In the example of FIG. 3*b*, four zones of extremely high conductivity are indicated by abrupt increases in the slope of the plot line at f1, f2, f3, and f4. Such abrupt and abbreviated plot segments are generally associated with fractures, or perhaps thin lenses of course sand, exhibiting high conductivity. The intervals having a shallow slope, such as those at t1, t2 and t3 in FIG. 3*b*, are indicative of "tight" geologic formations, zones of comparatively low conductivity. Portions of the plot manifesting moderate slopes, such as at p1 and p2 in FIG. 3*b*, correlate to comparatively permeable subsurface formations; the steeper the plot slope, the higher the conductivity of the corresponding formation.

At the total depth of the borehole ("TD" in FIGS. 3*a* and 3*b*), the liner reaches the bottom of the hole and its eversion stops. Further, it is apparent to one skilled in the art that the vertical thickness of a particular subsurface layer of particular conductivity may be determined by reference to data on the "depth in hole" axis of the plot. The graphs of FIGS. 3*a* and 3*b* are generally qualitative in character for purposes of illustration. In the practice of the invention both the domain and the range are plotted numerically to enable quantitative evaluation.

The inventive technique thus deduces from the liner's velocity profile the flow characteristics of each flow path sealed by the liner 10 as it descends vertically, by measuring the descent rate and the driving pressure in the liner (i.e., the excess load or water level 34 inside the liner 10).

Figure 2:
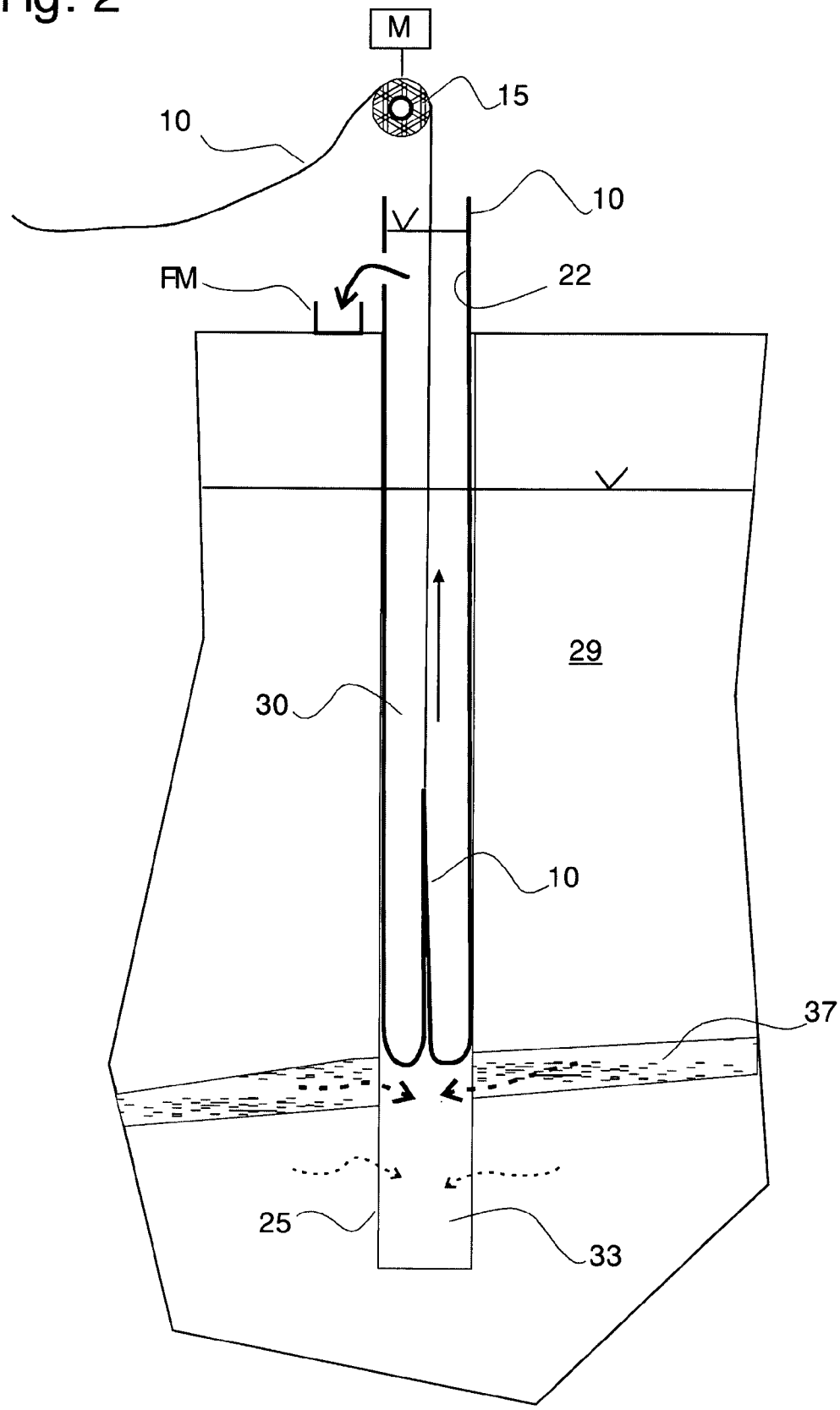
FIG. 2 is another sectional view of a preferred embodiment of the invention being operated in a borehole into the Earth's surface.

An alternative use for the invention is to measure the velocity of an ascending liner. The liner 10 motion is reversed by pulling upwards on the inverted liner 10 at the top of the borehole, and the resulting motion is indicated by a solid, straight directional arrow in FIG. 2. The principles of the alternative method are essentially the same as with a descending liner, simply approached from a "reversed" perspective. FIG. 2 shows the apparatus of the invention deployed for ascending liner methodology. A liner 10 progresses a significant distance up the borehole 25. The liner 10 preferably controllably wound upon a reel (not shown in FIG. 2) and is passed over a roller 15. The roller assembly 15 is equipped with tension and position metering devices M, known in the art, for measuring the amount (length) of liner 10 that has been paid out or reeled in, as well as for gauging the tension in the down-hole liner due to gravity. Thus, the meter M includes an encoder, in operative connection with the axle of the wellhead roller 15, to measure the depth of the everting liner in time. The metering equipment collected in component M also includes a means for monitoring continuously the driving pressure of the everting liner. This driving pressure monitoring means may be a "bubbler" for monitoring the driving fluid level 24 within the liner 10, or a simple pressure gauge (such as pressure meter PM2 in FIG. 1*a*) for directly measuring the driving pressure. Further use of the metering devices M in an alternative manner of practicing the invention will be explained later herein.

In the alternative method of an ascending (inverting) liner, the liner 10 is caused to invert as the central portion of the liner rises. The driving force is the tension on the liner. As the liner inverts and rises in the borehole, water is drawn into the borehole beneath the inversion point EP. The liner velocity can be measured by drawing the liner over the same roller. An alternative mode is to measure the flow rate out of the liner at the top of the casing 22 as the water spills over the top of the liner 10 as it is inverted. FIG. 2, for example, shows a flow meter FM for monitoring the fluid flow discharge from the ascending liner. The inversion causes the interior volume of the liner 10 beneath the surface pipe to decrease. The flow out of the liner 10 equals the flow into the borehole 25 beneath the inversion point. The flow measurement has the advantage that it is not affected by the stretch of the liner 10 nor by the variation of the diameter of the borehole 25. The velocity of the liner 10 over the roller 15 is affected by only a small error due to stretch of the liner under varying tension forces. The method of determining conductivity using an ascending liner thus preferably includes a step of measuring the flow rate of fluid produced from the top end of the liner, as well as monitoring tension in the liner itself.

Figure 4:
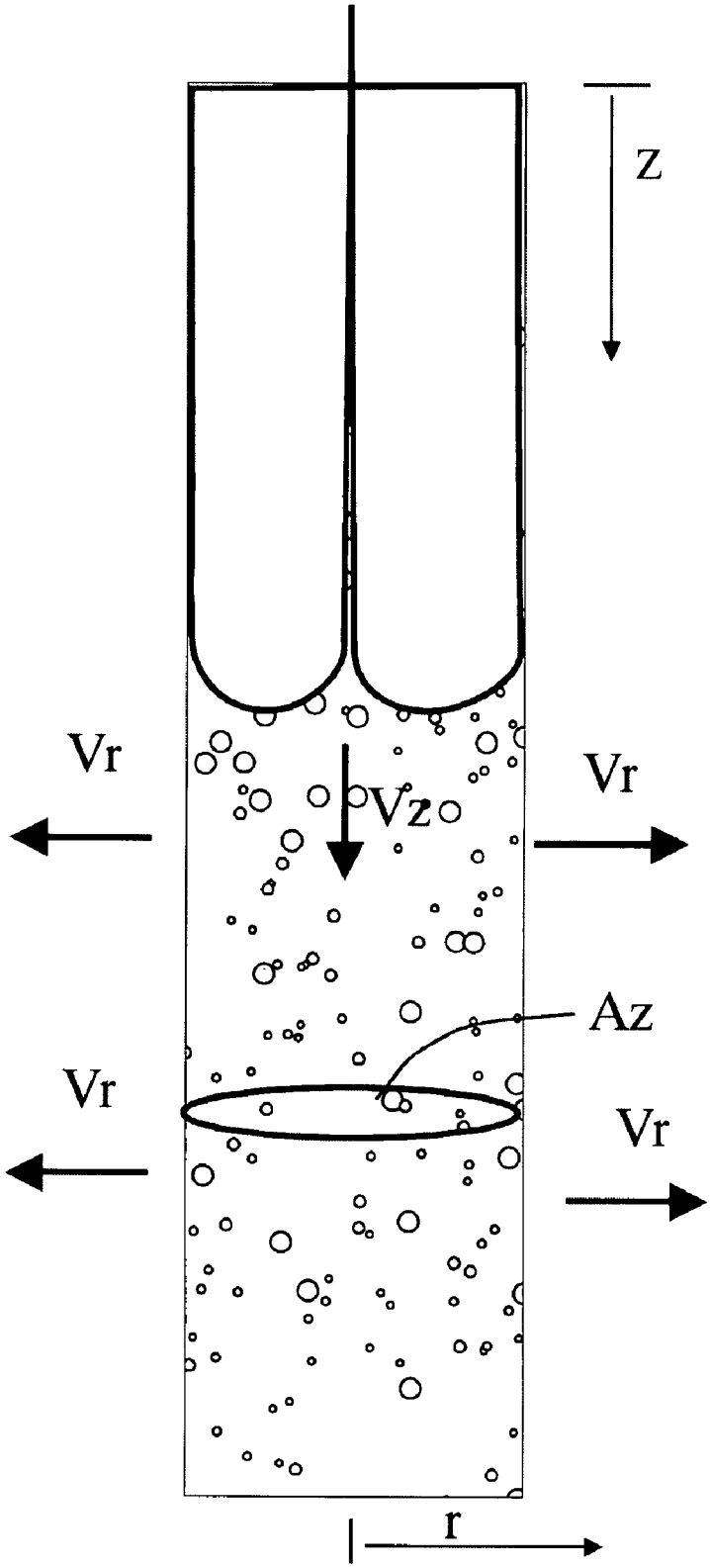
FIG. 4 is a diagram depicting certain geometric and hydraulic variables associated with the calculations used to determine transmissivity according to the present invention.

The driving force of the ascending liner 10 is the tension on the liner. The pressure in the borehole 25 beneath the ascending liner is dependent upon the tension in the liner as it rises. However, the pressure inside the liner 10 also affects the tension measured at the surface in the liner. Measurement of either the head in the liner, or the fluid pressure in the liner, coupled with the tension of the liner allows the deduction of the pressure in the borehole 25 beneath the liner 10 according to the simple approximation:

Tension $=A$ (Pressure inside the liner-the pressure outside the liner)/2 where A is the sectional area of the expanded liner (see $A_z$ in FIG. 4).

From this relationship, the pressure outside the liner 10 in the borehole 25 beneath the liner can be calculated. An increase in the tension will lower the pressure in the borehole 25 beneath the liner 10. As will be shown later, the upward velocity of the liner will increase with increased tension, but the rate of rise is still controlled by the flow rate into the hole borehole beneath the inversion point.

In this manner, for an ascending liner, one can deduce the transmissivity of the borehole 25 beneath the liner in a manner similar to that for a descending liner.

The invention uses an off-the-shelf liner 10, but adds the measurement of velocity (distance and time) to the roller 15. The water flow out of the liner is monitored continuously, for example by means of a flow meter FM gauging the discharge from within the liner 10 at its top end (FIG. 2).

Data regarding the ascent rate and deployed length of the liner 10 (from meters M associated with the roller 15) and regarding the discharge from within the liner (from meter FM) are recorded on a conventional high-speed lap top computer as the liner is installed or removed. The data reduction is performed digitally in the computer as the data is collected. When the liner 10 reaches the top of the borehole 25, the plot of the conductivity profile can be printed.

For deep water table installations, the hanging weight of the liner 10, especially for segments of the liner free-hanging in the vadose zone (in FIG. 1), and any additional restraining tension also is measured by meters M and recorded to calculate the proper conductivity profile. In areas having a very deep water table 28, it may be desirable to blow air into the liner 10 to inflate it against the walls of the borehole 25, thereby reducing the friction of the inverted liner against the liner pushed against the borehole wall (the everted liner).

The actual results are measured as changes in the transmissivity of the wall of the borehole 25 correlated to the descent or ascent of the liner 10. Given the length of the increment of the hole measured, effective conductivity is calculated. This can be related to an effective fracture aperture if the number of fractures is known.

The method described above for a descending liner is the usual mode of use. The ascending liner technique has the additional necessity to measure the tension on the liner above the hole. The ascending liner procedure is most useful, however, for liners which have been emplaced beneath the surface and filled with water as described in the prior U.S. Pat. No. 6,298,920. This installation uses a push rod (also called a rigid casing). Once the rod is removed, the liner is left filled with water to above the surface. A tube connects to the bottom end of the liner for the purpose of inverting the liner from the hole. As the tube is withdrawn from the hole, the inverting liner connected to the tube is also withdrawn. The same procedure and data reduction for the ascending liner apply. The advantage of this technique is that a stable open hole is not required. The internally pressurized liner is usually adequate to stabilize an otherwise unstable in unconsolidated sediments. Since the liner emplaced via push rods has another purpose, the removal procedure performed and measured as described offers additional utility to the liner installation.

In all descending liner embodiments of the invention, the liner forces the ambient ground water into the surrounding formation because of the excess head in the liner. The excess head in the liner is measured relative to the head in the formation. An initial assumption in this invention is that the head in a subsurface formation is uniform. When the head profile in the formation becomes known, the assumption of a uniform head in the formation can be corrected to the actual head as needed. However, the driving pressure in the liner (excess head) usually exceeds substantially the natural head in the formation.

Another assumption underlying the invention is that the water flow from the borehole below the liner is radial, essentially horizontal and one dimensional. This approximation is not particularly significant to the utility of the invention. As the liner descends, it seals, sequentially, the flow paths from the borehole with a resulting drop in the liner descent rate. It is assumed that the flow from the borehole is steady state. Since the gradient near the borehole wall, which dominates the flow, develops relatively quickly, this is not a significant limiting assumption. In practice, the liner 10 descent is relatively continuous with very few stops.

A third legitimate assumption is that the flow rate out of the borehole is equal to the descent velocity of the liner multiplied by the cross section of the borehole. The borehole cross section may not be constant, the effect of cross section variations with depth can be addressed in the analysis.

Finally, it is assumed that the liner either everts with very little frictional resistance or the eversion resistance is corrected by a small adjustment in the driving pressure. Since the liners have been very well tested, the correction is small and reliable. Other forms of friction, drag, buoyancy, etc. are addressed further hereinafter.

A model for performing data reduction according to the present invention is shown in FIG. 4, which depicts the geometry of the calculations used in the invention. Z is the distance down the borehole. The liner descent may be compared to a perfect-fitting piston. The radial flow (Qr) out of the borehole is approximated by a one-dimensional flow field obeying Darcy's law:

$$Qr=Ar\ Vr=2\pi rHK/\mu dP/dr$$

where Ar is the radial flow area traversed by velocity Vr. H is the height of the radial flow area, K is the medium permeability, μ is the viscosity of water, and dP/dr is the pressure gradient.

Separating variables and integrating gives:

$$ln(r_o/r_a)=2HK(Pa-Po)/(\mu Qr)$$

where $r_o$ is the borehole radius and $r_a$ is the range to ambient pressure, Pa. Po is the pressure in the borehole. Po>Pa. Qr is the radial, horizontal flow out from the borehole. The flow out of the borehole should equal the rate at which water is being displaced downward by the liner. That is, Qr=Qz. where Qz is the vertical flow rate. The vertical displacement by the liner is: Qz=Az Vz, where (Az) is the cross section of the hole and (Vz) is the line descent rate. By measuring the liner descent rate, Vz is known. A caliper log provides $Az=\pi r^{o2}$ as a function of the borehole depth. A very useful result can be obtained by assuming that $r_o$ is a constant.

It is noteworthy that there is no reason to expect the liner descent to be other than a monotonic decreasing velocity history. Therefore:

$$Qr=Qz=2\pi HK(Pa-Po)/(\mu\ln(r_o/r_a)$$

Solving for K provides the effective conductivity of the entire open borehole below the liner. This is a useful result, but not a profile of the borehole.

A central aspect of the inventive conductivity profiling technique is to assume that as the liner descends, it will cover flow paths, resulting in a change in Qz as reflected in $v_z$ or, $$Qz(z_i)-Qz(z_{i+1})=$$

$$\delta Qz_i=\delta v_{zi}Az_i=\delta Qr(z_i \text{ to } z_{i+1})=-2\pi\delta z_iK_{zi}(Po-Pa)/(\mu\ln(r_o/r_a)$$

$K_{zi}$ is the permeability of the interval $\delta z_i=z_{i+1}-z_i$, covered by the liner during time interval $\delta t_i=t_{i+1}-t_i$.

Solving for the permeability of the interval, $K_{zi}=\delta v_{zi}A_{zi}\mu\ln(r_o/r_a)/(-2\pi\delta z_i(Po-Pa))$ The important parameter, $\delta v_{zi}/\delta z_i$, is determined from the recorded data. The "i" subscript is introduced because of the time and distance discrete collection of the data. The smoothing of the data and proper centering of the variables is part of the data reduction done by a computer program written for that purpose, a task within the skill of the known programming arts.

Another factor in the actual measurement of a descending liner is that the tension on the liner 10 is not zero. The tension must be adequate to support the liner above the water level (34 in FIG. 1) in the liner. Any excess tension will reduce the driving pressure of the excess head.

Notably, installation of an everting liner will progress more rapidly in subsurface regimes of high transmissivity. However, in formations of low transmissivity, installation necessarily will progress slowly, because the invention provides a method of directly measuring transmissivity. If the velocity descent goes to zero before the total depth is obtained, then the near-impermeability of formations below the zero-velocity level may be inferred.

It is apparent to one of ordinary skill in the art that the measuring method of the invention may be performed using the ascending, rather than descending liner technique. The principles and mathematical equations are generally the same; they are simply applied while the liner 10 is being extracted from, rather than installed into, the borehole 25. A transmissivity profile may be generated using the system shown in FIG. 2, where the powered reel is used to pull the liner 10 from the borehole while monitoring the tension the liner 10 exerts on the roller 15. In this alternative mode of practicing the invention, the tension in the ascending liner above the point of eversion EP is the main driving force. It thus is essential to use the metering equipment M associated with the roller 15 to continuously measure the tension in the liner as the liner is taken up and wound around the reverse-powered reel. The excess head (difference in the head of the fluid 30 and the standing ground water 33 must also be closely monitored and logged. By measuring tension versus the liner's ascending velocity, the conductivity profile can be determined during the withdrawal of the liner, as native ground water flows into (as opposed to out of) the borehole 25 below the everting liner 10, as indicated by the convoluted directional arrows in FIG.

Figure 12A:
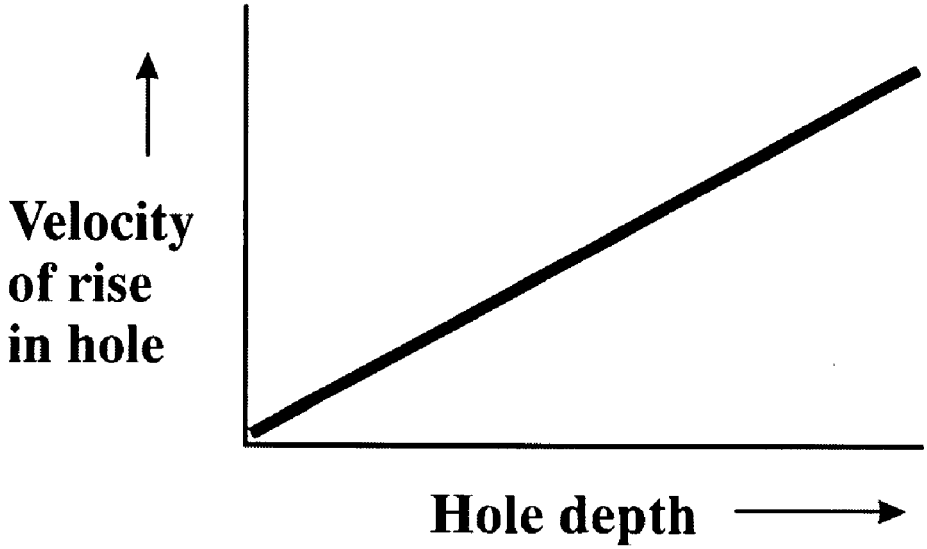
FIG. 12*a* is a graph showing qualitatively a hypothetical transmissivity profile that might be obtained by practicing the invention in a subsurface medium of uniform transmissivity, when the invention is alternatively practiced by withdrawing an ascending everting liner out of the borehole, rather than driving the everting liner down the borehole.
Figure 12B:
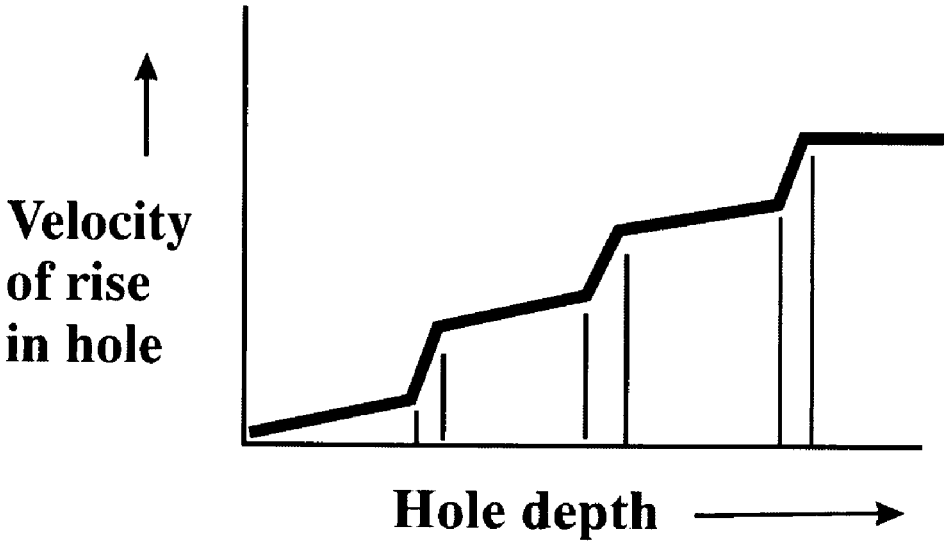
FIG. 12*b* is a graph showing qualitatively a hypothetical transmissivity profile that might be obtained by practicing the invention in a subsurface medium of non-uniform transmissivity, when the invention is alternatively practiced by withdrawing an ascending everting liner out of the borehole, rather than driving the everting liner down the borehole.

FIGS. 12*a* and 12*b* are qualitative graphs showing hypothetical plots of liner ascending velocity versus hole depth in an "ascending liner" measurement. FIG. 12*a* is analogous to FIG. 3*a*, and suggests what the graph generated by a liner ascending through a homogenous or uniformly permeable medium might look like. FIG. 12*b* offers a graph analogous to FIG. 3*b*, and provides a hypothetical plot generated by a liner ascending through several strata of differing transmissivity. Like FIGS. 3*a* and 3*b*, the abrupt and steep segments of the plot are indicative of permeable zones or fractures, while shallow slopes suggest tighter formations.

Figure 13:
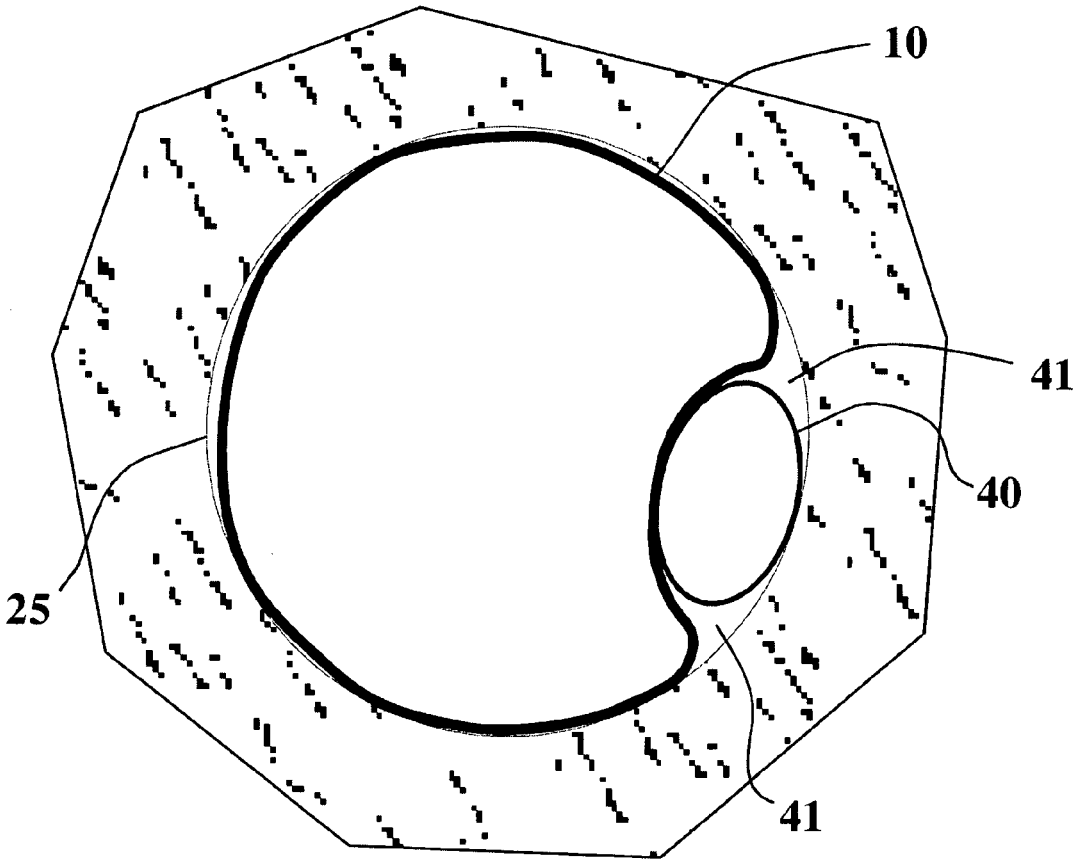
FIG. 13 is an enlarged radial cross section of a borehole with a primary liner installed therein and a secondary tube inflated to partially displace the primary liner.

Reference is made to FIG. 13. The use of an ascending liner eversion point to measure transmissivity during liner withdrawal may be eased by the use of a secondary tube 40 installed parallel to the main liner 10. The secondary tube 40 is originally co-installed in advance of, or with, the liner 10, but not inflated in any way; when the liner 10 is reeled toward the surface for de-installation, the secondary tube 40 is inflated with any suitable pressurized fluid, thus pushing aside the liner 10 as seen in FIG. 13. As the liner 10 shifts aside, fluid flow paths 41 are opened to allow water to flow in during liner withdrawal.

It is noted that the secondary tube may be placed, but is not inflated, during the descent of the main liner 10 while a measurement is being made. The secondary tube 40 is inflated during removal (ascent) only to speed the ascent of the main liner when no measurements are being performed, thus providing the practical benefit of rapid de-installation of the apparatus.

A small secondary tube 40 or liner also may be useful for the descending liner technique. The descending liner uses an additional device to aid the withdrawal of the liner after the measurement has been completed. In a relatively low permeability formation, the liner installation may require several hours or more to descend to the bottom of the hole. The removal of the liner is performed by pulling upward on the inverted liner, or a cord attached to the closed end of the liner. The inflow into the borehole may be very slow and hence the liner 10 removal may require a time as long as the installation required. In order to greatly reduce the removal time, a small diameter, empty, flat liner (FIG. 13) can be lowered into the borehole prior to the liner installation. The small liner may be (but is not necessarily) closed at the bottom end and open at the top end. The liner installation and transmissivity measurement is unaffected by the flat, collapsed small liner. The inflated liner seals well against the flat small liner.

Prior to removal of the large liner by inversion, the small liner is filled with water to dilate it to a nearly circular cross section (FIG. 13). The opens an interstitial space 41 between the liner 21, the borehole wall 25, and the small liner 40. The interstitial space serves as a conductive path to flow paths in the formation high above the eversion point. This allows water to flow more quickly from the formation into the borehole beneath the ascending liner. In that manner, the liner can be raised much more quickly from the borehole than if there were no such connection to flow paths above the eversion point. The small liner is not necessary to perform the measurement that is the substance of this invention, but it allows the measurement to be performed in a reasonable length of time.

The invention may also find use in evaluating the flow field in the media between the borehole 25 and any nearby monitoring wells. As conductivity profiling is being performed according to the invention as described, the installation of a descending liner produces a line pressure source of decreasing length in the borehole 25. Monitoring the effect of the line boundary condition in nearby monitoring wells may offer insight into the flow field between the borehole 25 with the descending liner 10 and the monitoring wells nearby. The position of the liner 10 and the driving head in the liner are measured as a function of time. The liner 10 can be driven, in this instance, as fast as needed with a gravity water supply, and the decreasing line source gives more special resolution than an entire pumped well. Further, there is no concern about a bypass of the liner providing a spurious "source." The liner 10 can be inserted at a measured head and removed with a measured head and a measured tension (equals a measured drawdown).

Thus, an alternative is offered to simply pumping on a single hole to develop a boundary condition, or doing packer interval extractions to test the flow field to the monitoring wells. Modern modeling techniques can then reproduce the decreasing line source for assessment of the data obtained in the monitoring well(s) and the implied flow field in the area as driven be the descending (or ascending) liner 10.

It also is immediately apparent that the invention may find practical utility in various types of conduits other than vertical boreholes. For example, the inventive technique may be employed to test for and locate leaks in conventional pipes. The method can be practiced in non-vertical boreholes. The liner alternatively can be driven by air or other fluid besides water. And, a person of skill in the art of hydraulic engineering could perform an assessment of head profiles by halting, then reversing, the descent of the liner.

It also should be noted that in the preferred embodiment, the head in the liner is used as the driving pressure for the system, which is corrected for the liner tension to determine the driving pressure beneath the liner. However, one can measure the head beneath the liner directly by lowering a pressure transducer into the borehole "ahead" of the liner, e.g., before the insertion of the liner. This short cut to the driving pressure in the system is very useful in some cases. It is not as useful, however, if the transducer must be left in place for a long time, since the transducer cannot be removed without first removing the liner.

Figure 14:
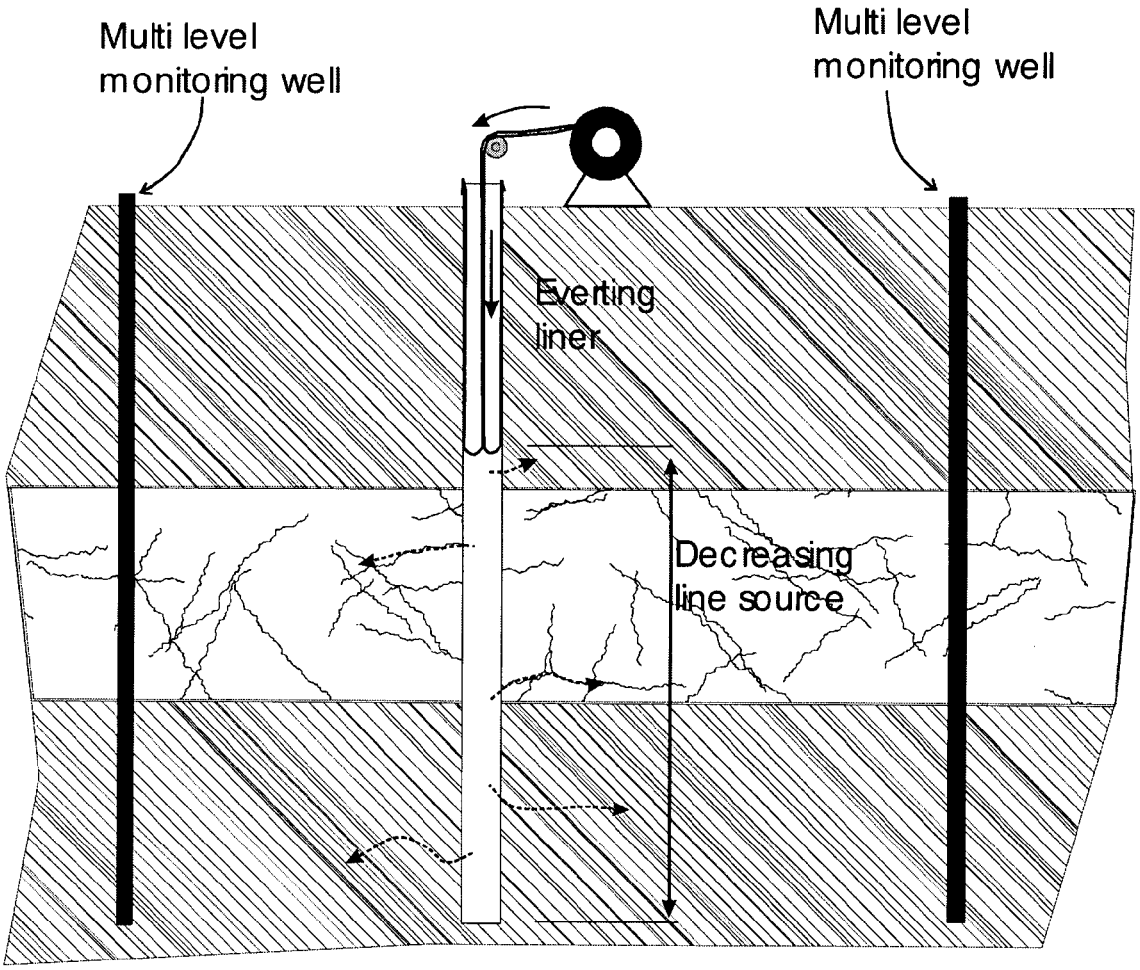
FIG. 14 is a side sectional view (of varying scale) of an embodiment of the present invention being practiced below the surface of the ground, illustrating that an everting liner can produce a decreasing line source whose effect can be measured in nearby boreholes.

Attached as FIG. 14 is a drawing that shows how an everting liner can produce a decreasing line source whose effect can be measured in nearby wells. The result is a more spatially dependent determination of the connection between the driving source in the pressurized borehole and the response in the nearby wells. With the modern modeling capabilities, this is especially interesting; the installation of a blank liner in a borehole in fractured rock produced water level changes in nearby wells. As the liner descends, the upper connections are eliminated, leaving only the result of the lower portion of the borehole.

An alternative data collection and calculation method is possible for the same basic apparatus as described herein above. However, instead of collecting the velocity history for the liner descent, one can measure carefully the rate of water addition to the liner and the level of water in the liner. From these two measurements, one can calculate the flow rate of water out of the borehole beneath the liner.

Figure 15:
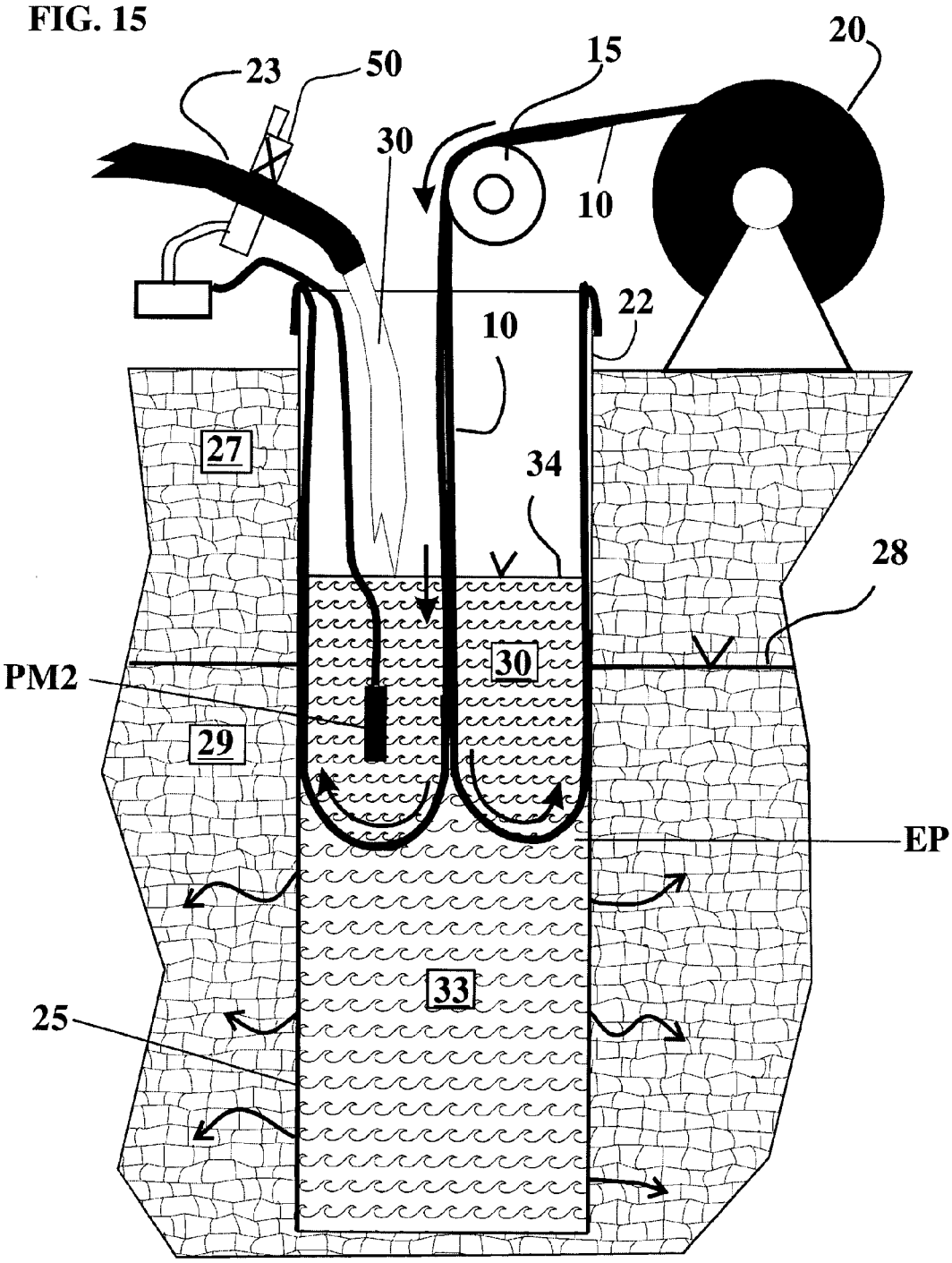
FIG. 15 is a side sectional view (not to scale) of an alternative embodiment of the present invention being practiced below the surface of the ground, illustrating that the rate of introduction of driving fluid into the liner can be monitored to measure outflow from the borehole in order to obtain conductivity data for surrounding media.

Reference is made to FIG. 15, showing the apparatus of the invention used to practice the alternative method whereby the desired data is obtained by measuring the flow of driving fluid into the liner. The elements and components of the apparatus, as well as the overall methodology, are generally the same as in the embodiments described previously herein, except that instead of monitoring the descent velocity of the eversion point, the rate of driving water introduction is monitored. Thus, beneficial reference is made to the previously described methods, except as now discussed.

As explained, the liner 10 is progressively filled with driving fluid 30, preferably water, introduced via above-ground fluid conduit 23. The driving fluid is poured into contact with the "outside" surface of the liner 10, but as a result of the pressure of the driving fluid 30 pushing the liner 10 down the borehole 25, the collapsed tube of the liner is pressed against the walls of the borehole, resulting in the eversion of the liner. The eversion of the liner 10 occurs at a constantly moving eversion point EP as an ever greater length of the liner fills with driving fluid 30.

As a result of the rapid introduction of driving fluid via the conduit 23, the driving fluid 30 fills the liner 10 to a driving fluid level 34 ordinarily somewhat above the vertical datum of the water table 28, as suggested by FIGS. 1 and 15. At any given point along the borehole column, therefore, the hydraulic head within the liner 10 somewhat exceeds the head attributable to ambient subsurface water, such as the pressure from the saturated aquifer 29.

In this alternative method, additional driving fluid 30 is introduced at a controllably variable rate, with the rate being regulated and measured by a regulator and flow meter apparatus 50 of known conventional construction and function. By the use of flowmeter-regulator 50, the rate at which the driving fluid is introduced can be continuous monitored over times, as well as regulated as needed. In the practice of the invention, the discharge of the driving fluid 30 from the conduit 23 into the liner 10 is measured and recorded over time. Further, the flowmeter-regulator is controllably operated, either manually or automatically, to maintain the driving fluid level 34 at as nearly a stable elevation as possible.

It is understood that during the practice of the invention, the driving fluid level 34 may fluctuate somewhat due to changing conditions in the borehole affecting the progression there-through of the eversion point EP. When a decrease in the elevation of the driving fluid level 34 is detected, the discharge rate of the driving fluid through the conduit is increased to restore the selected level 34. Similarly, if the driving fluid standing in the borehole rises significantly above the pre-selected level 34, the fluid discharge is correspondingly deceased to allow the fluctuating fluid level to equilibrate to the assigned driving fluid level 34. Regulation of the discharge by the flowmeter-regulator 50 may be facilitated or even automated by the use of a pressure meter PM2. Pressure meter PM2 measures the head of driving 30 fluid standing in the borehole, and can be calibrated to detect fluctuations in pressure due to departures from the selected elevation of the driving fluid level 34. From such fluctuation measurements the movement of the actual driving fluid level can be determined, both as to magnitude and direction. Further, such fluctuations can be signaled to a computer which in turn actuates the flowmeter-regulator 50 to adjust the rate of fluid introduction accordingly. Thus, the driving fluid level 34 ideally remains stabilized at a pre-selected elevation during practice of the invention, but the invention includes the monitoring of the actual level and the adjustment of driving fluid discharge to correct departures from the selected level 34. Alternatively, computational corrections within the ordinary skill in the art also can adapt the computational processes to account for fluctuations in the driving fluid level.

This alternative methodology employs the same computational analyses as described previously herein, except that instead of using the change in velocity of the liner's eversion point EP, the changes in the rate of driving fluid introduction are measured and monitored. Such changes are measured and recorded over time by operation of the flowmeter-regulator 50 (preferably in communication with an associated digital computer). From the recorded discharge data (i.e., flow rate versus time), the rate of driving fluid introduction can be correlated to changes in flow rate into discrete strata at various elevations in the borehole 25. One can determine a flow rate change into surrounding formations from the following additional equation:

$$Q_{in}=Q_r-(v_s)(A_z)$$

Where $Q_{in}$ is the rate of water addition to the liner, $Q_r$ is the radial flow (F in FIG. 15(*a*)) from the borehole, $v_s$ is the velocity of the water surface inside the liner, and $A_Z$ is the cross section of the hole at the water interface. If the liner descent slows, the interface velocity will rise. The increase in $v_s$ is a measure of the flow rate into the flow path that was covered by the descending liner.

Thus, the method of the invention includes using the measurement and monitoring of the rate of driving fluid introduction ($Q_{in}$) instead of the liner velocity measurement as explained in the discussion of other embodiments. Further, this alternative method may serve as a redundant measurement method to obtain better quality data overall.

Figure 16:
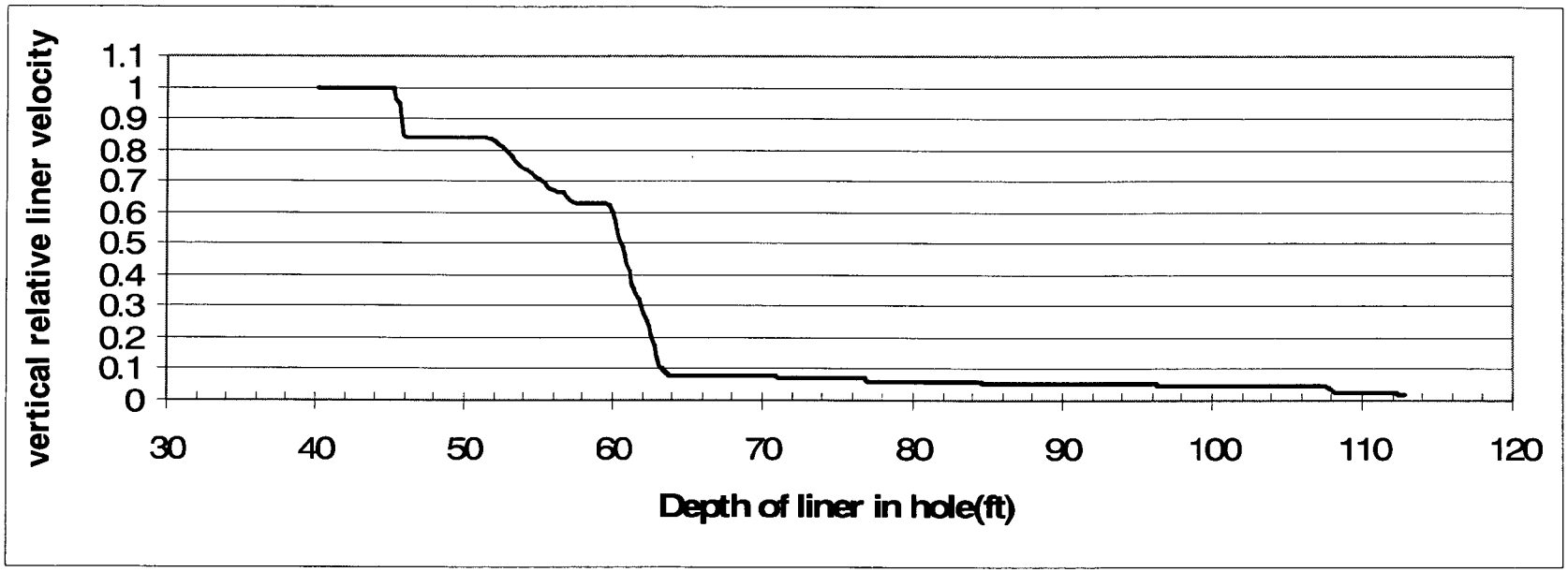
FIG. 16 is a graph of the vertical relative liner velocity versus the depth of the liner in a certain first test borehole, from data derived in about three hours.
Figure 17:
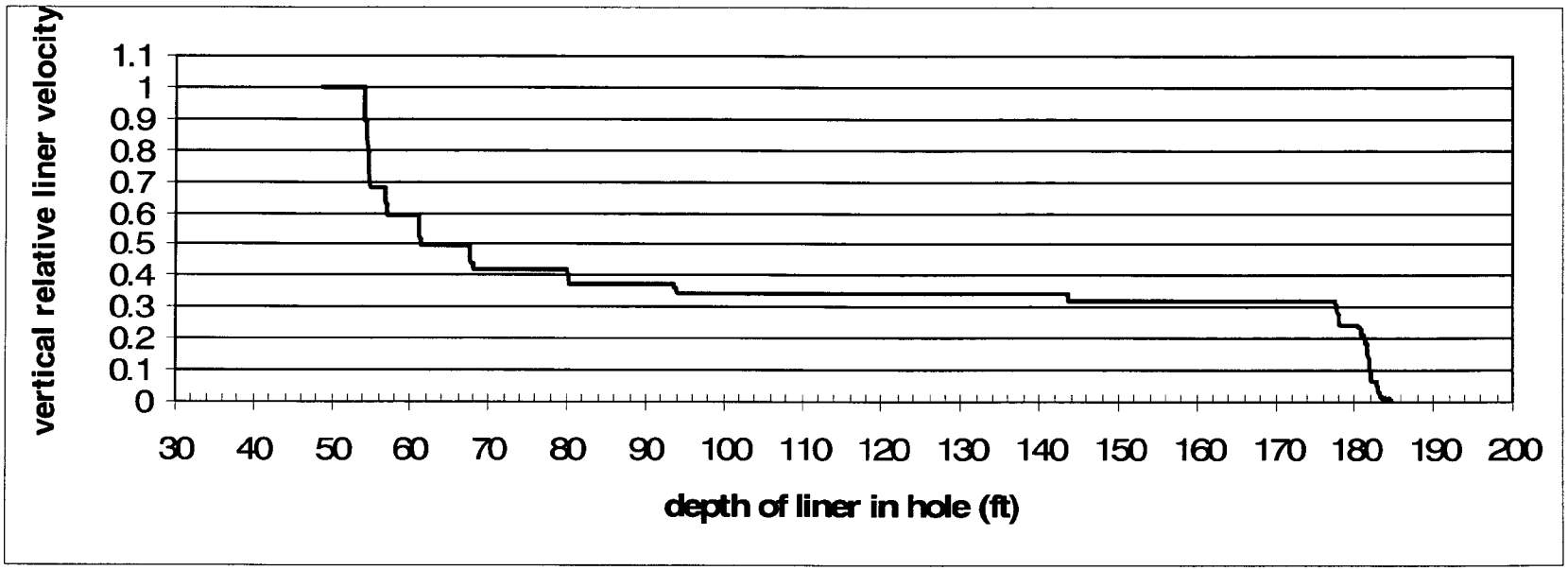
FIG. 17 is a graph of the vertical relative liner velocity versus the depth of the liner in a certain second test borehole, from data derived in about thirty minutes.

For purposes of further illustrating the invention and its advantages, conventional "straddle packer" data was obtained for comparison with results of the invention, as obtained using the "liner velocity" method of the invention in two test boreholes. Additional information and disclosure in this regard is depicted in captioned FIGS. 16-20. FIG. 16 is a graph of the vertical relative liner velocity versus the depth of the liner (EP) in a certain borehole PW-1. Advantageously, this data was obtained in about three hours, in marked contrast with the time typically required to perform traditional straddle packer tests. FIG. 17 is a graph of the vertical relative liner velocity versus the depth of the liner (EP) in a borehole PW-2, obtained in only about thirty minutes.

Figure 18:
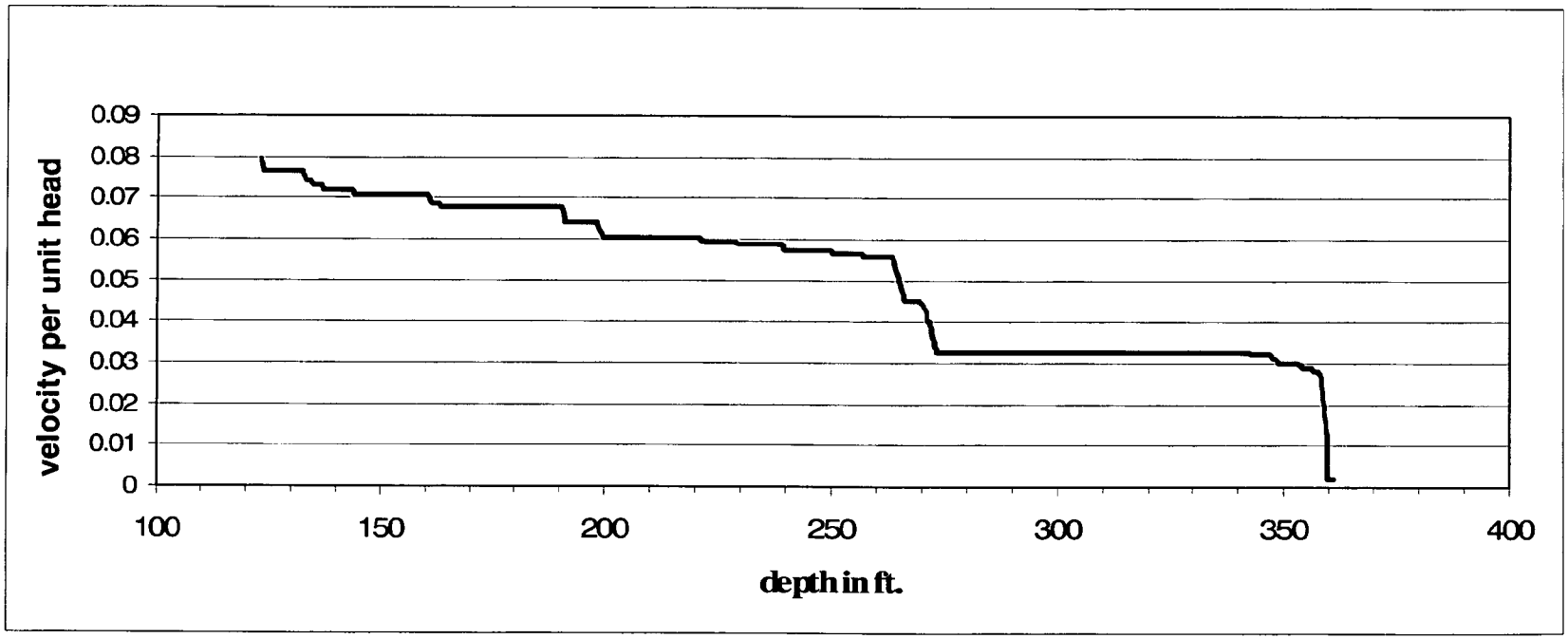
FIG. 18 charts the liner velocity down yet another test hole (per unit head) as a function of depth.
Figure 19:
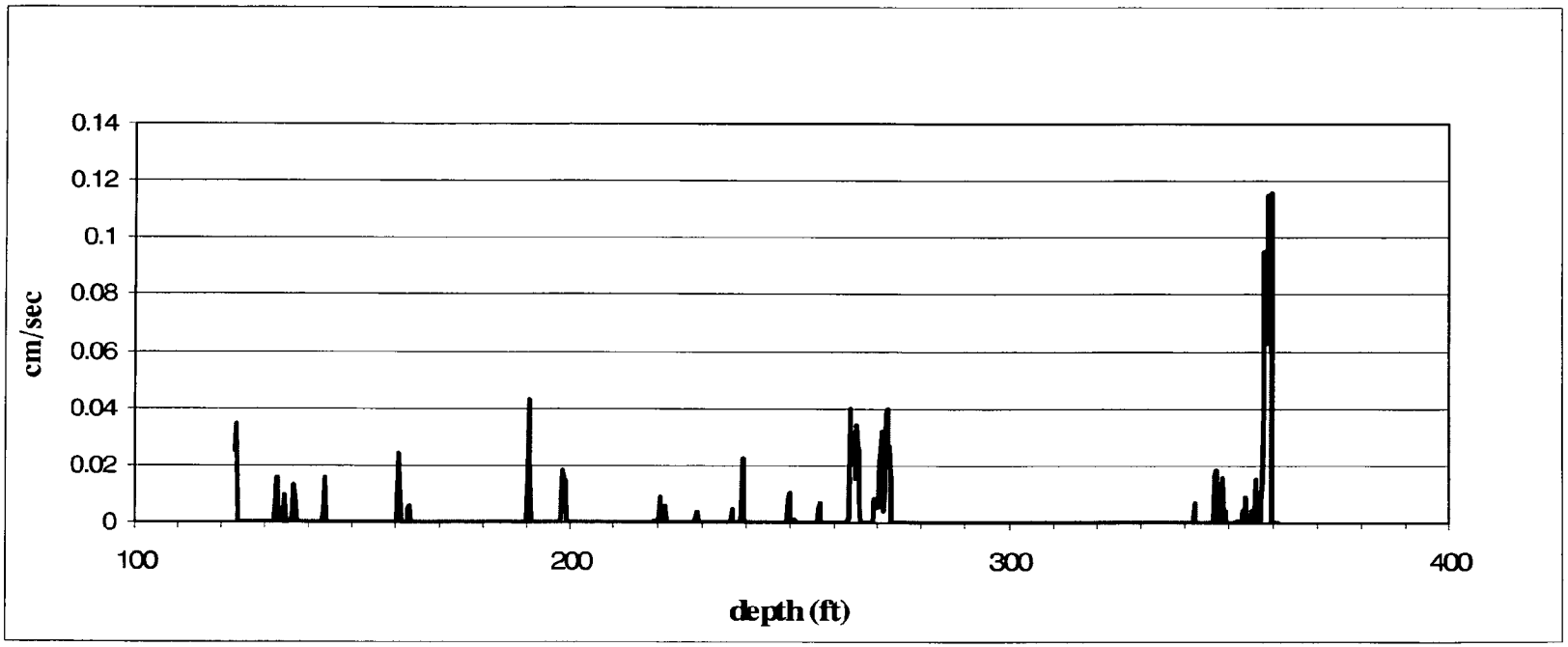
FIG. 19 is a graph of the calculated conductivity profile in the test hole of FIG. 18.

In another instance, an 8-inch diameter borehole 650 feet deep was tested using both the inventive (liner velocity) method and a conventional straddle packer method. FIG. 18 charts the liner velocity (i.e. of the eversion point EP) down the hole (per unit head) as a function of depth. The inventive method was performed in about three hours. FIG. 19 is a graph of the conductivity profile in the borehole, per the inventive method. Straddle packer intervals were eleven feet, except for the bottom interval of 287 feet.

The inventive method was practiced, and the data reduced. The packer data was obtained for comparison. The FIG. 18 results are a plot of the velocity history in the borehole, from which the conductivity distribution (FIG. 19) was calculated.

Figure 20:
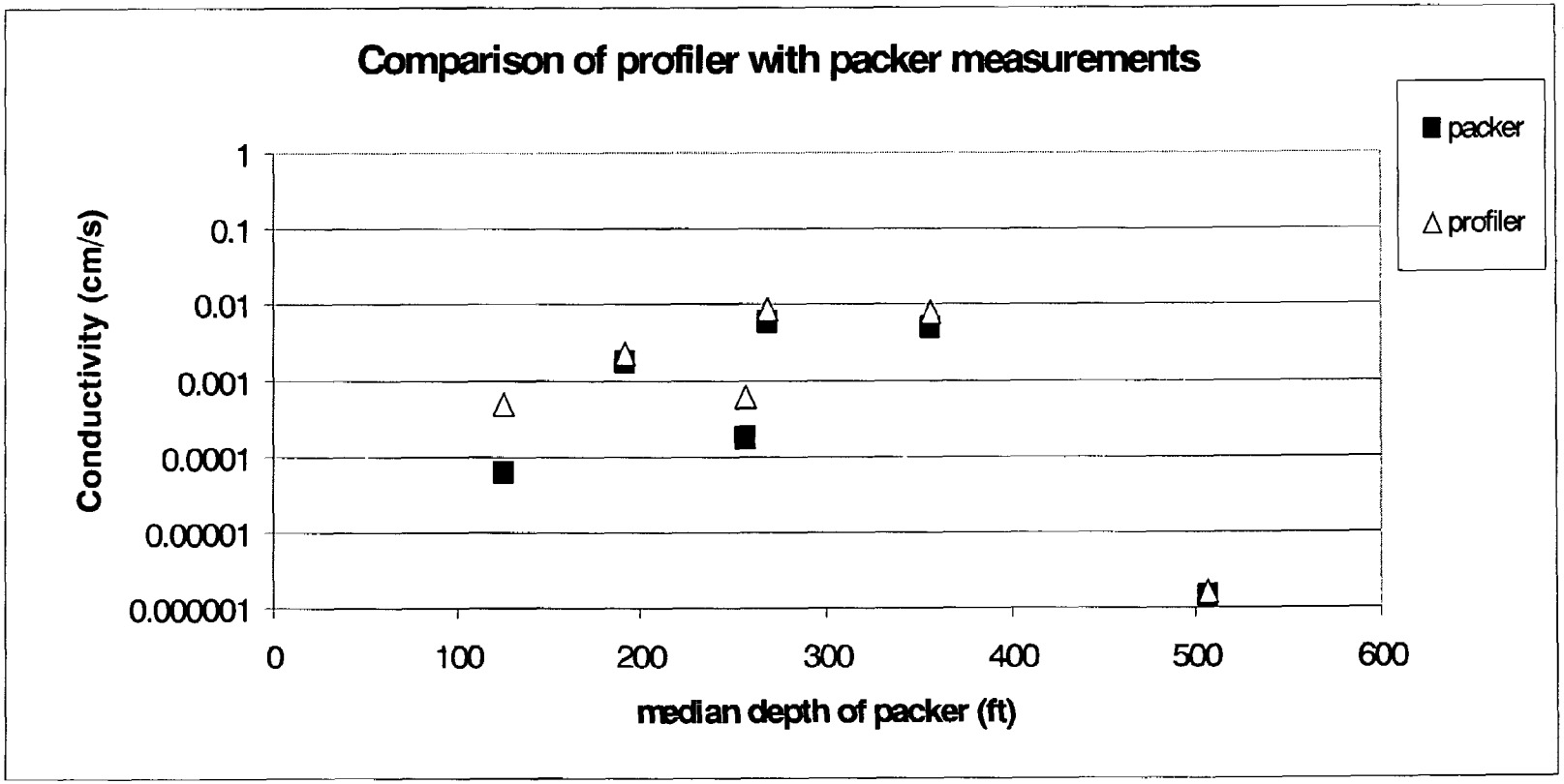
FIG. 20 is a graphical comparison of the data obtained from the methodology of the invention as practiced for FIGS. 18 and 19, compared to data obtained from conventional straddle packer procedures performed in the same test hole.

FIG. 20 is a comparison of the integrated results of the method of the invention, over the same straddle packer interval, with the straddle packer test result. The comparison is remarkable for the two very different methods. The deepest value was for a single packer flow test of the entire bottom of the borehole below 363 feet. The inventive method result used in the liner velocity at 365 feet to calculate a flow rate into that bottom portion of the borehole. (On FIG. 20, the data points are plotted at the middle of the intervals to which they correspond.) As can be seen in FIG. 20, the conductivity as determined by the method of the invention compares very favorably to that obtained by conventional straddle-packer methodology; but the method of the invention permitted the conductivity data to be obtained much faster and with fewer and less-educated technicians in the field.

INDUSTRIAL APPLICABILITY

The invention is further illustrated by the following non-limiting example.

A conductivity profiling system generally in accordance with the foregoing disclosure was implemented and tested. The first data collected was the observation that the descent rates of blank liner 10 installations were highly variable for different boreholes and sometimes changed abruptly. The velocity of tape marks on the liner gave flow rates into the formation. When the applicant built "linear capstans" for liner removal, they were instrumented to measure tension of the liner and depth with time. Then digital recording was added to collect the data. Bubblers were used to monitor the water level inside the liner to determine the excess head in the liner.

An early experimental test of the method was performed at Cambridge, Ontario, for the University of Waterloo. A linear capstan was coupled with laptop computer recording to measure the parameters in the equation herein above. The parameters not measured were borehole diameter, and the range from the borehole to a known pressure (Pa to $r_a$). (If Pa is defined as the ambient pressure, and $r_a$ is estimated (guessed), the error in the $\ln(r_o/r_a)$ is not large relative to the much larger range of conductivity for the formation.)

An advantage of the University of Waterloo installation was that a complete set of packer tests had been done on the 330 ft, 6 in diameter borehole. The comparison of the inventive profiler with the Waterloo data is shown hereafter. The packer testing required 4 four days to perform. The measurement by the inventive method required about 1.5 hours, including set up.

Figure 5:
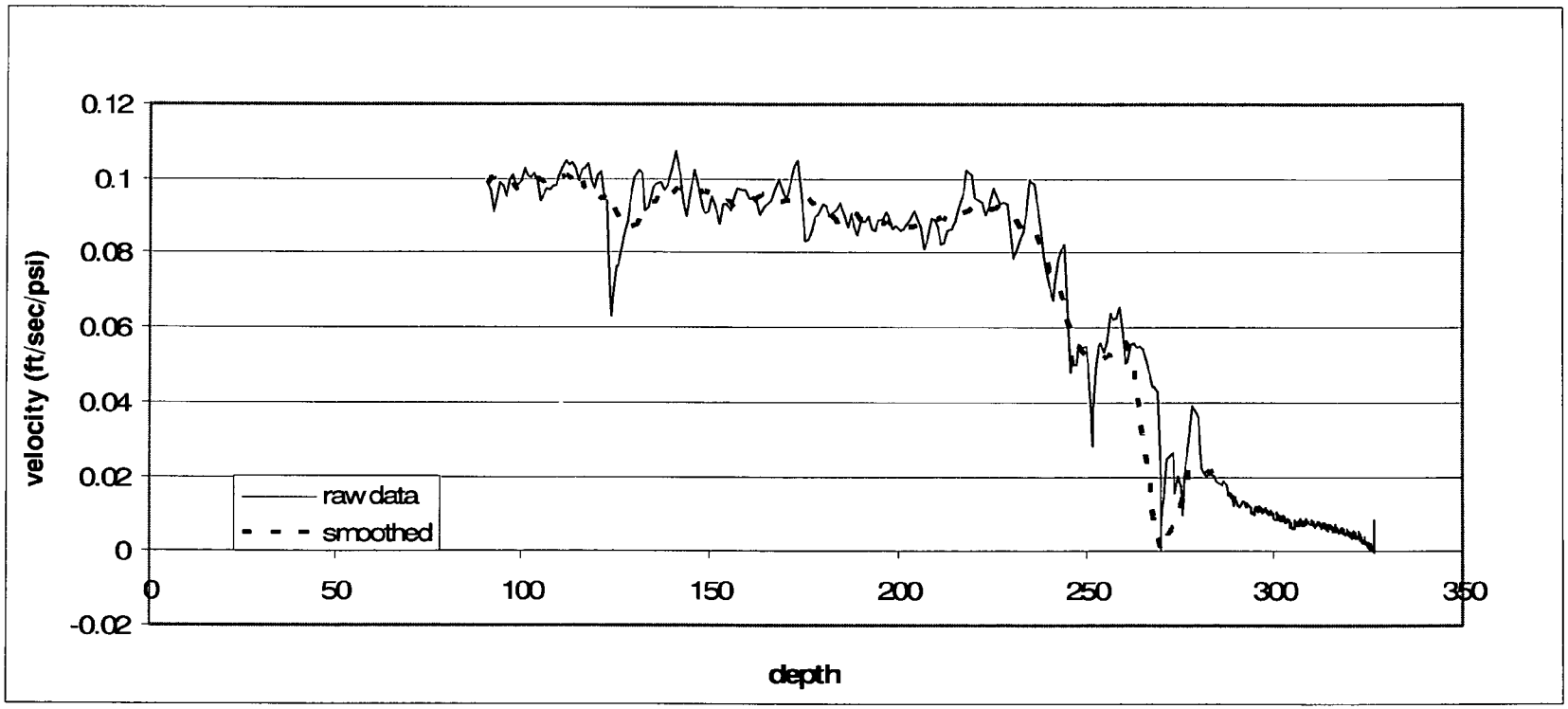
FIG. 5 is a graph, plotting velocity (ft/sec/psi) versus depth (m), showing a velocity profile measured from the bottom of a bore hole casing to the bottom of the hole; the raw data provides the ragged velocity profile (darker plot), while the normalized smoothed curve (the lighter curve, smoothed over a forty second interval) is shown overlaying the raw data reduction.

The velocity profile measured from the bottom of the casing to the bottom of the borehole is shown in FIG. 5, a plot of velocity (ft/sec/psi) versus depth (m). The raw data provides the ragged velocity profile (darker plot in FIG. 5). The occasional drops to a zero or near zero velocity are due to operational pauses in the installation. Those can be ignored, but they do affect the smoothed velocity curve. The normalized smoothed curve (the lighter curve, smoothed over a forty second interval) is shown on top of the raw data reduction. As explained further hereafter, the expansion of the liner into an incidental enlargement of the borehole caused the liner descent rate to slow due to the increased cross section of the borehole. This obviously was not related to flow out of a fracture. As the borehole diameter returned to its normal diameter at a lower elevation, the liner speed recovers. To overcome this effect, a monotonic decreasing curve was fit to the velocity data to extrapolate over the dips in the velocity curve.

Figure 6:
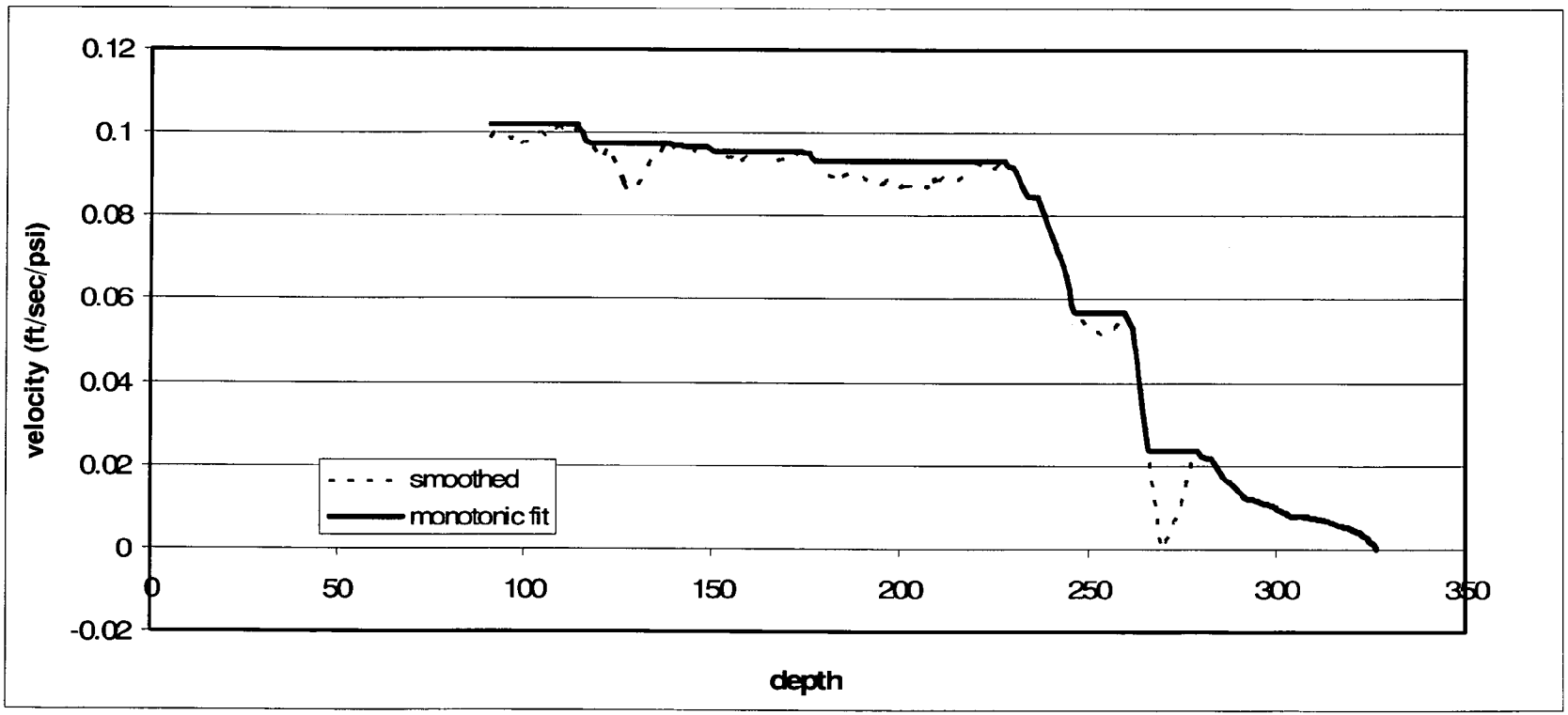
FIG. 6 is a graph, plotting velocity (ft/sec/psi) versus depth (m), showing a monotonic curve (light-colored plot) overlaying the normalized curve from FIG. 5 (darker plot)

The monotonic curve is shown as a separate light-colored curve in FIG. 6 with the smoothed curve from FIG. 5. This monotonic curve is used to distribute the transmissivity of the borehole in the proper regions. If the monotonic velocity curve is normalized (as illustrated by FIG. 6) to the maximum value (the initial velocity value), the curve is a plot of the fraction of the flow remaining in the borehole below the liner as a function of the liner depth. The sharp drops are an indication of the flow lost as the liner descends and covers the flow paths.

Figure 7:
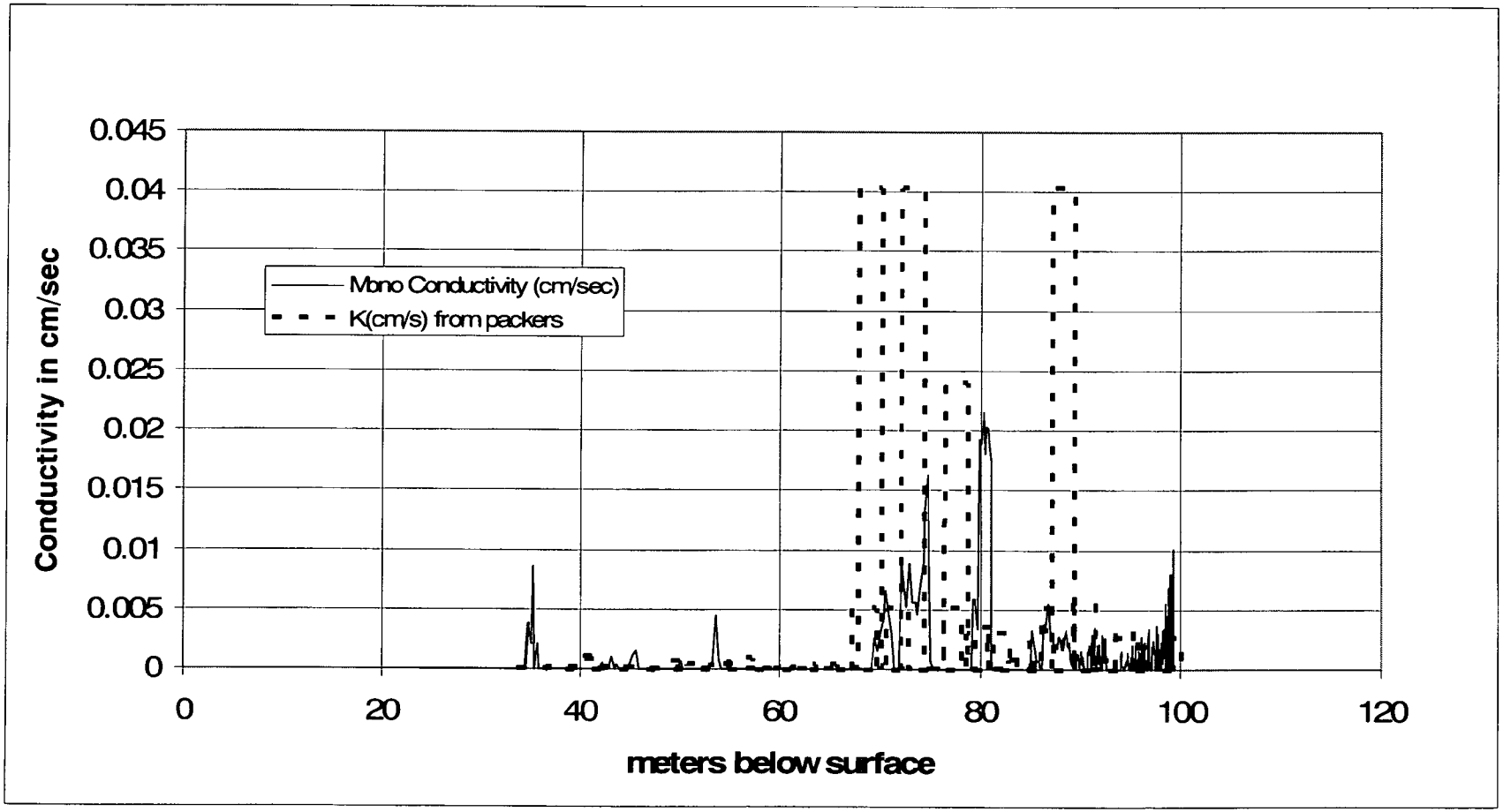
FIG. 7 is the log plot of a conductivity profile (lighter plot) determined from a series of straddle packer tests, and a (darker) plot of the mono conductivity deduced from measurements performed by the invention.

FIG. 7 is the log plot of the conductivity profile measured by the series of straddle packer tests. Conductivity (K), in cm/sec, is plotted for packer tests on the vertical axis versus depth below surface (meters) on the horizontal axis. The mono conductivity deduced from measurements performed by the invention is plotted on the same graph. Some of the large packer values are lower conductivity zones as measured by the invention. This may be due to packer leakage.

Figure 8:
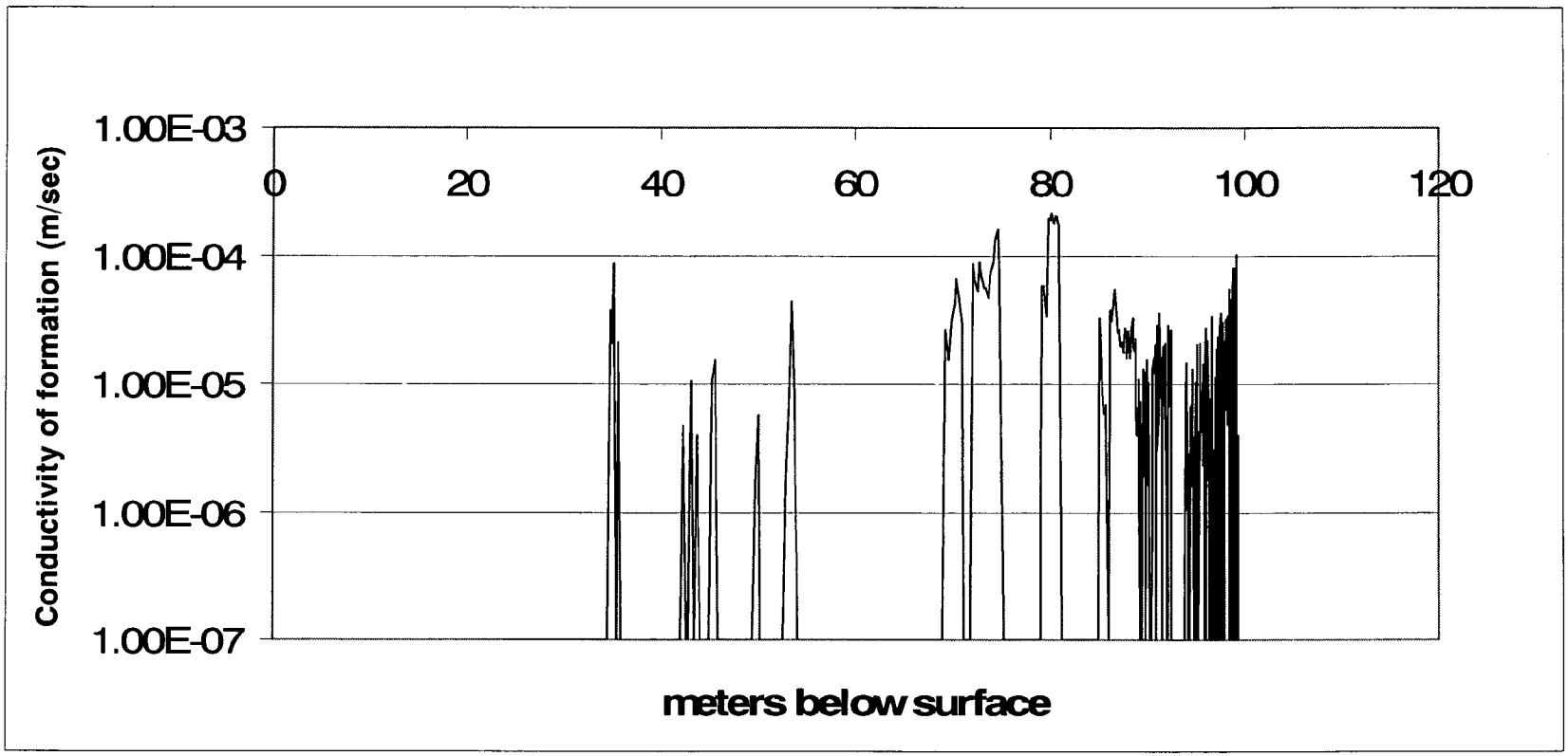
FIG. 8 is a log plot of certain packer-test conductivity data versus depth in meters.

FIG. 8 is a log plot of the packer data with depth in meters. It is noteworthy that the straddle packer tests average the apparent flow over the measurement interval of the packer. That is not quite the same as the liner velocity measurement. Yet the large flow paths clearly occur in the same parts of the hole.

It is noted that the comparison of the invention testing with packer tests is not a test of the model, except that there should be a correlation of high and low flow zones. Packer isolation of a segment of the borehole depends upon the packer seal to the borehole wall and the connection between the isolated interval via the medium (e.g., fractures) to the borehole above or below the pair of packers.

Commonly installed packers nearly always leak more or less. In highly fractured zones, the packer pair will probably leak a great deal. In tight sections where the borehole wall is likely to be smooth, and the flow paths past the packer are less likely, the amount of leakage is probably small, even though it may still be a large fraction of the flow into the medium. The result is that a complete series of packer tests (i.e., the entire borehole is measured) will predict a total flow greater than that into, or out of, the medium in a whole borehole transmissivity test. The integral of the packer test is an upper bound on the flow capacity of the entire borehole. Packer tests are often done with measurements of pressure above and below the packers for detection of leakage.

In the operation of the invention, however, there are two distinct segments or portions of the borehole 25: the sealed section above the point of eversion EP, and the unsealed borehole below the point of eversion. As the liner 10 descends, it will not seal an extremely rough borehole wall or a breakout larger in diameter than the liner 10. In such an instance, there is upward flow to horizontal flow paths above the eversion point EP. However, when the point of eversion EP reaches a section of borehole which can be sealed, the leakage is stopped between the unsealed and the sealed portion of the borehole 25.

Figure 9:
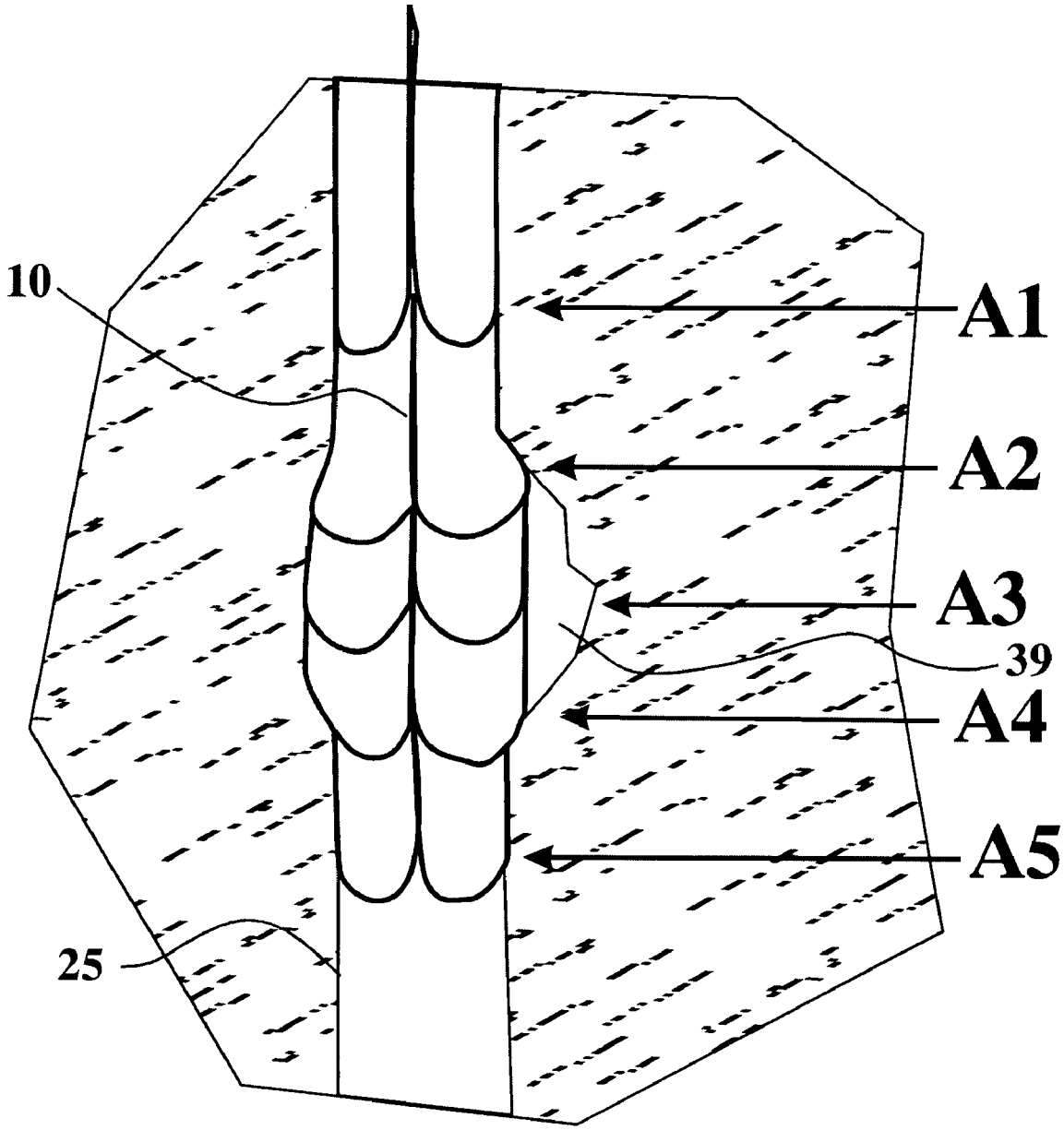
FIG. 9 is an enlarged graphical depiction of an everting liner according to the present invention, shown in five different positions progressing down a bore hole past an irregular break-out or other expansion in the diameter of the borehole.

In the situation just described, the integral of flow from the borehole 25 is correct. The error introduced by an imperfect seal of the borehole 25 is to compress the borehole conductivity of the unsealed portion of the borehole (if there is any conductivity in that portion) into the zone immediately above the well-sealed segment of the borehole. Reference is made to FIG. 9, showing a sequence of liner positions as the liner 10 descends (everts) through a "breakout" in the borehole or other hole enlargement 39. At position A1, the liner diameter matches the nominal diameter of the borehole 25. At A2 the liner dilates into an enlargement. At A3, the liner is at its maximum size, which is less than the breakout diameter. At A4 the liner is again sealing the borehole at less than the liner's maximum diameter. Finally, at position A5, the liner 10 is back to the nominal diameter of the borehole 25.

Between positions A2 and A4, the liner 10 is not sealing the borehole 25 and flow can continue out of the breakout 39. For that short interval, the assumption that the flow occurs only out of the borehole below the liner's point of inversion is violated. In that interval also, the velocity will not change with depth. At A4, the flow into the breakout 39 is stopped and the liner may see an abrupt drop in velocity. If there is no flow out of the breakout 39, there will not be a drop in the liner velocity at A4.

Another effect of the borehole diameter not being constant with depth is discussed here. Non-uniform diameter of the borehole 25 causes a decrease in the liner descent rate as the liner 10 dilates into the larger diameter (e.g., A2-A4 in FIG. 9). Such an event could be interpreted erroneously as a permeable interval covered by the liner. However, when the hole converges (A5), the liner velocity increases (a contradiction of the expectation of a monotonically decreasing velocity as flow paths are covered). The reason for the velocity change is that $Vz=Qr/Az$. If Qr, the radial flow out of the borehole is constant, Vz s inversely proportional to $Az=\pi r_0^2$. A small change in $r_o$ can change the velocity significantly (e.g., a radius increase of 10% is a 20% area and velocity change). If a caliper log is available, the correct diameter can be used in the model.

Such variation of $v_z$ is addressed by ignoring temporary dips in the velocity versus hole depth curve. The effect of the model is to compress any real flow path conductivity into the upper portion of the enlarged interval (FIG. 9 at A4), because that is where the descent velocity will drop due to any loss into the breakout 39. The model, and the measurement, will recognize the difference between the velocity at A1 and A5 due to flow into the breakout.

These two potential perturbations of the conductivity profile inferred from the data will cause shorter regions of conductivity higher than the actual value, but the total fracture or permeable bed flow capacity is conserved. Therefore, the inventive apparatus and method results may produce some short spikes for enlarged regions that may be better measured by ordinary packers, if the packers are located so as to straddle a permeable breakout zone bounded by impermeable zones at the packer locations.

The ability to measure packer leakage in the borehole above or below the straddle packer depends upon the transmissivity of the borehole above or below and the pressure developed between the packers. However, the generalization that packers produce only an upper bound on reality seems to be valid. Also, the generalization that a descending liner is measuring relatively correctly the transmissivity of the borehole below the liner seems to be valid.

A potentially better test of the invention, but one which has not been conducted, would be a vertical flow meter map of a heavily pumped borehole. However, in such a test the borehole must be pumped with a draw down that overwhelms the natural head at any place in the borehole.

Experience has shown that the higher the head that drives the liner, the better is the data quality, because the small perturbations do not affect a relatively high velocity of installation. However, for very permeable boreholes, it requires a relatively large flow rate for the water addition to maintain a substantial head.

Figure 10:
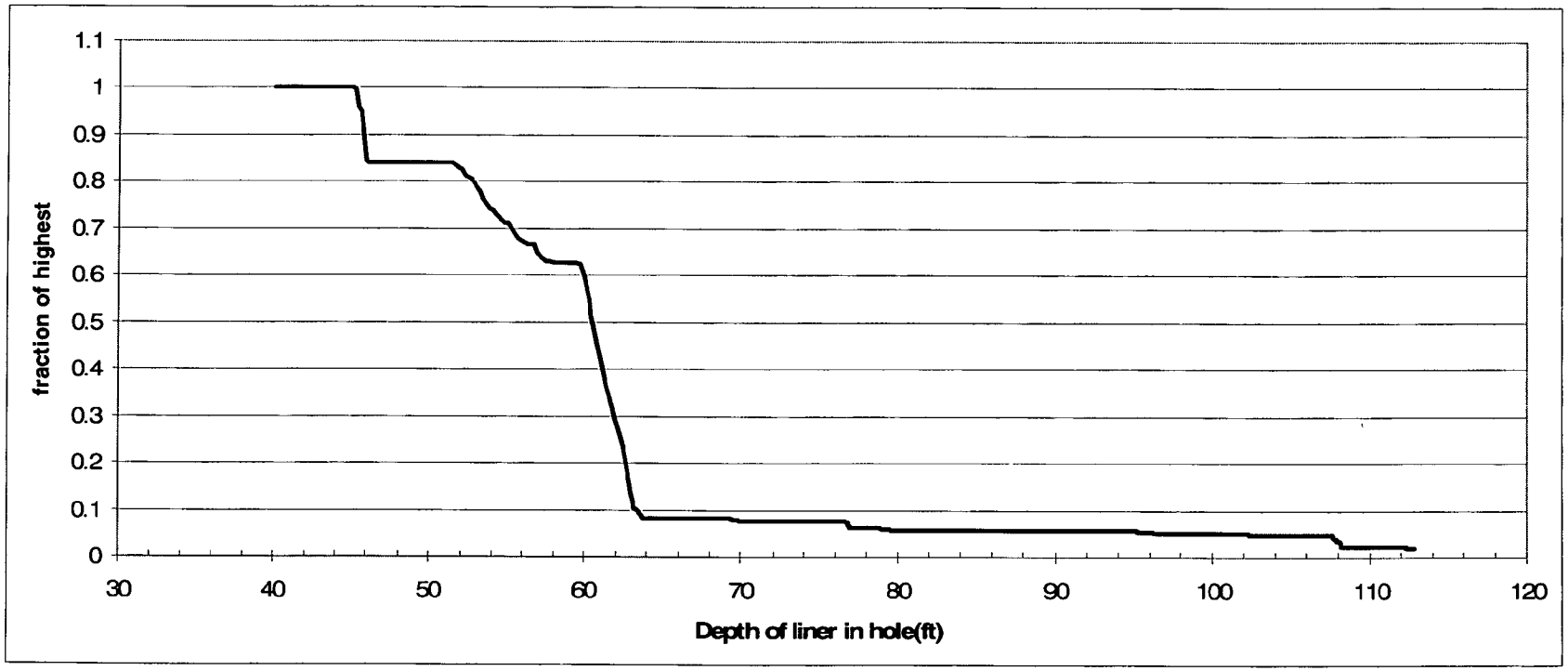
FIG. 10 is graph showing a conductivity profile generated by an actual down-hole field test of the present invention.

For boreholes with relatively low conductivity, the water addition can be relatively slow, but the difficulty is that the liner descent rate can be so slow that the entire traverse can not be done in a reasonable time (e.g., a few hrs to a day). Since the liner descent always slows, it may also be that a measurement is practical in only the upper portion of the borehole where the velocity of descent is greater. FIG. 10 shows a profile taken in a borehole with most of the conductivity between 40 ft. (from the bottom of the surface casing) and 63 ft. By that depth, 92% of the effective flow paths had been passed. The installation was terminated at 116 ft. of a 190 ft. borehole because the descent rate was so slow.

Figure 11:
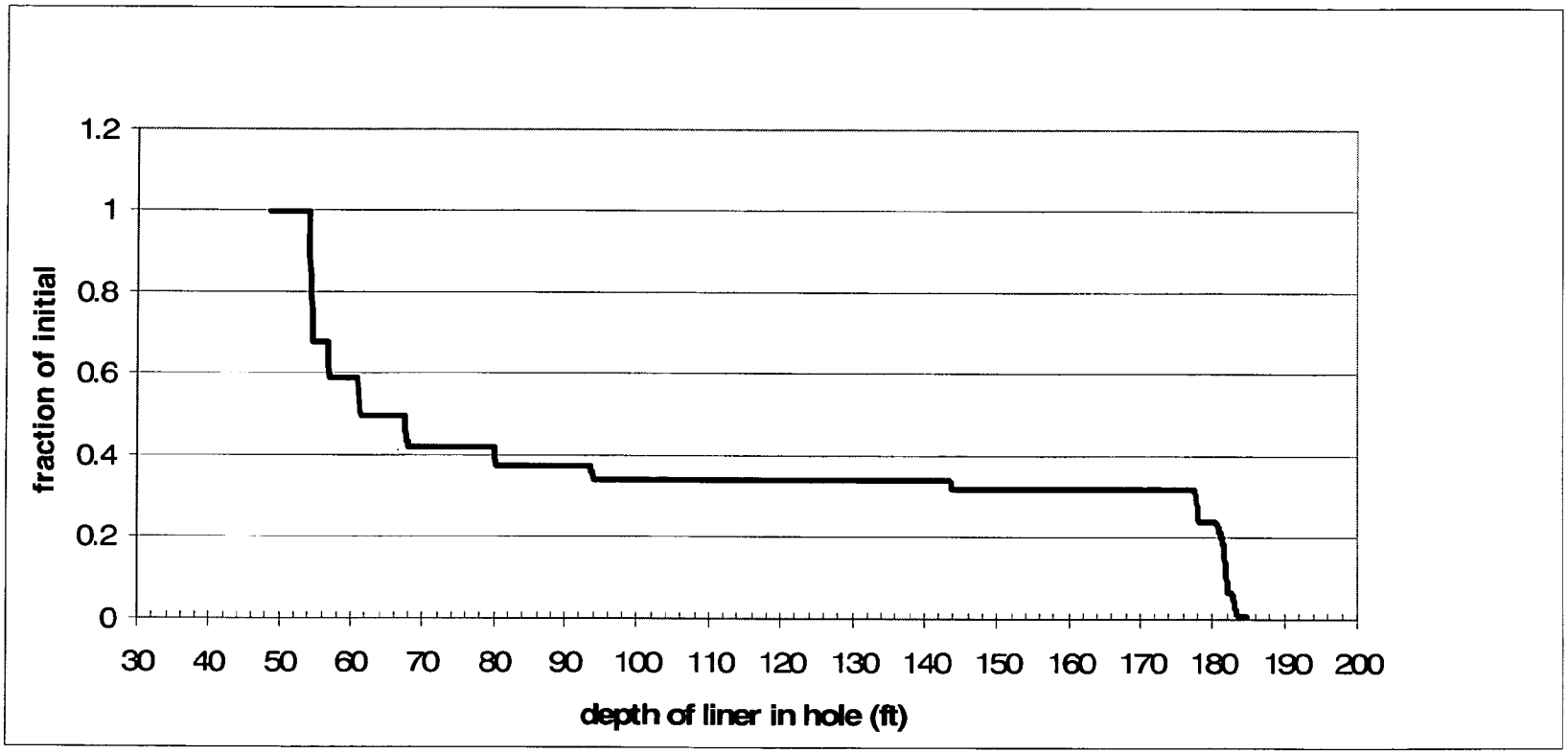
FIG. 11 is graph showing a conductivity profile generated by another actual down-hole field test of the present invention in a hole near the hole of FIG. 10.

In contrast, another profile, shown in FIG. 11, taken in a nearby borehole shows that approximately 35% of the borehole flow was out of a fracture pair only 3 ft. above the bottom of the borehole. This installation went easily to the bottom at 185 ft.

Accordingly, the installation of a blank liner to seal the borehole to be tested offers the capability of determining the conductivity profile of the subsurface regime. The measurement of the liner's descent rate can provide useful information about the distribution and capacity of the flow paths out of the borehole. Effects of borehole diameter variations, ruguosity, and fractures in the formation have much less effect on the liner measurement than they have on the measurements performed with a complete suite of straddle packer tests.

Advantageously, the invention offers a relatively direct measurement of the distribution of the flow paths in the borehole. Conventional geophysical measurements are very indirect measurements of the possible flow paths from a borehole (although flow meter and temperature measurements are exceptions to the generalization). Further, the inventive method generates conservative results; it always closes leakage around the liner due to borehole irregularities once the point of eversion reaches the next undisturbed (nominal diameter) portion of the borehole.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of determining hydraulic conductivity of material surrounding a conduit or borehole, comprising the steps of: sealably fastening a first end of a flexible liner to a proximate end of the borehole; introducing a driving fluid into the liner to a driving fluid level, thereby everting the liner down the borehole; measuring the rate of driving fluid introduction; monitoring changes in the driving fluid level; and calculating the conductivity of the surrounding material from the rate of driving fluid introduction and from any changes in the driving fluid level.

2. The method of claim 1 wherein introducing driving fluid into the liner comprises pressurizing the liner with a fluid.

3. The method of claim 2 wherein pressurizing the liner with a fluid comprises pressurizing the liner with water.

4. The method of claim 2 comprising the further steps of monitoring the pressure within the liner and monitoring liner tension to determine a driving pressure.

5. The method of claim 2 comprising the further step of measuring fluid pressure in the borehole below an everting end of the liner.

6. The method of claim 2 wherein the step of calculating conductivity comprises determining a gross fluid flow rate outward into the surrounding material from a segment of the borehole at an everting end of the liner.

7. The method of claim 6 wherein the step of measuring the rate of driving fluid introduction comprises monitoring for changes in the rate of fluid introduction, wherein when the liner covers a flow path in the surrounding material, the gross fluid flow rate is reduced by the amount of flow in the flow path, concurrently affecting the rate of driving fluid introduction.

8. The method of claim 7 comprising the further step of plotting the rate of driving fluid introduction versus borehole depth to locate changes in conductivity associated with changes in fluid introduction.

9. The method of claim 1 wherein the step of measuring the rate of driving fluid introduction comprises discharging driving fluid through a flow meter adjacent to the proximate end of the borehole.

10. The method of claim 1 wherein the step of monitoring changes in the driving fluid level comprises monitoring a pressure meter in the fluid within the liner.

11. The method of claim 1 further comprising the step of withdrawing the liner upward in the borehole so that the liner ascends the borehole.

12. The method of claim 11 comprising the further step of monitoring a tension due to the resistance, to ascension, of the ascending liner.

13. The method of claim 12 comprising the further step of measuring fluid pressure in the borehole below an everting end of the liner.

14. The method of claim 11 further comprising the step of measuring the rate of driving fluid produced at the first end of the liner.

15. A method of determining physical characteristics of materials surrounding a subsurface borehole, the borehole having at least some ambient water standing therein, comprising the steps of: sealing an upper end of a flexible liner to a proximate end of the borehole; driving the liner down the borehole, while allowing the liner to evert at an eversion point descending the borehole, by introducing a driving fluid into the liner; continuously measuring the rate at which driving fluid is introduced into the liner; determining, from the rate at which the driving fluid is introduced, a gross flow rate of the ambient water outward into the surrounding material from a segment of the borehole adjacent the eversion point of the liner; and calculating from the gross flow rate a characteristic of the surrounding material.

16. The method of claim 15 wherein the driving fluid is introduced into the liner up to a changeable driving fluid levels.

17. The method of claim 15 further comprising the step of monitoring changes in the driving fluid level.

18. The method of claim 17 comprising the further step of monitoring changes in the rate of driving fluid introduction, wherein when the liner covers a flow path in the surrounding material, the gross fluid flow rate is reduced by the amount of flow in the flow path, concurrently affecting the rate of driving fluid introduction.

19. The method of claim 18 comprising the further step of calculating conductivity from the gross flow rate outward into the surrounding material.

20. The method of claim 19 comprising the further step of plotting the rate of driving fluid introduction versus borehole depth to locate changes in conductivity corresponding to changes in the rate of driving fluid introduction.

21. The method of claim 15 comprising the further steps of:

installing a secondary tube alongside the liner in the borehole; pulling the liner from the borehole; and supplying fluid via the secondary tube to the borehole below an everting end of the liner.

22. A method of determining hydraulic conductivity of material surrounding a borehole, comprising the steps of:

fastening an end of a flexible liner to an end of the borehole;

introducing a driving fluid into the liner, thereby everting the liner down the borehole;

measuring the rate of driving fluid introduction;

monitoring changes in a driving fluid level within the liner; and calculating the conductivity of the surrounding material.

* * * * *